United States Patent [19]

Butcheck et al.

[11] 4,154,437

[45] May 15, 1979

[54] MULTIPLE BILL DETECTOR FOR CURRENCY DISPENSERS

[75] Inventors: James D. Butcheck, Canton; Harry T. Graef, Dover; James L. McWhorter, East Sparta; John E. Price, Massillon, all of Ohio

[73] Assignee: Diebold, Incorporated, Canton, Ohio

[21] Appl. No.: 815,981

[22] Filed: Jul. 15, 1977

[51] Int. Cl.[2] ..... B65H 5/22; B65H 7/12

[52] U.S. Cl. ..... 271/6; 271/263

[58] Field of Search ..... 271/262, 263, 64, 4–6; 209/111.7 T

[56] References Cited

U.S. PATENT DOCUMENTS

| | | | |
|---|---|---|---|
| 3,244,971 | 4/1966 | Thompson | 271/263 X |
| 3,744,047 | 7/1973 | Allen | 271/263 X |
| 3,778,051 | 12/1973 | Allen | 271/263 UX |
| 3,795,395 | 3/1974 | Ransom | 271/263 X |
| 3,826,487 | 7/1974 | Forster | 271/263 |
| 3,938,663 | 2/1976 | Carnes | 209/73 |
| 3,976,198 | 8/1976 | Carnes | 271/263 X |

*Primary Examiner*—Richard A. Schacher

*Attorney, Agent, or Firm*—Frease & Bishop

[57] ABSTRACT

A detector mechanism and system for currency dispensers for automatic banking equipment which senses the presence of multiple or double bills, called "doubles," at any bill location in a series of bills intended to be fed one by one in a path of travel from a supply of bills to a place of delivery to a customer. The bill thickness of each bill is gauged continuously while moving in the path of travel, and the thickness measurements are time averaged over substantially the entire length of the gauged portion of the bill. The averaged and normal bill thicknesses are compared to determine if the averaged thickness is greater than the normal thickness by a predetermined amount. A greater thickness determination generates a signal of the presence of doubles, and the signal actuates means to reject the doubles while moving in the path of travel before delivery of the doubles to a customer.

30 Claims, 31 Drawing Figures

20
18
64
22
24
24a
65
66
70
69
79
68
16
29
17a
67
25
25a
17
81
28
23
74
26
26a
17b
27
27a
19

18
22
24
24a
29
17a
25
25a
16
28
23
17
B
26
26a
17b
27
27a
19

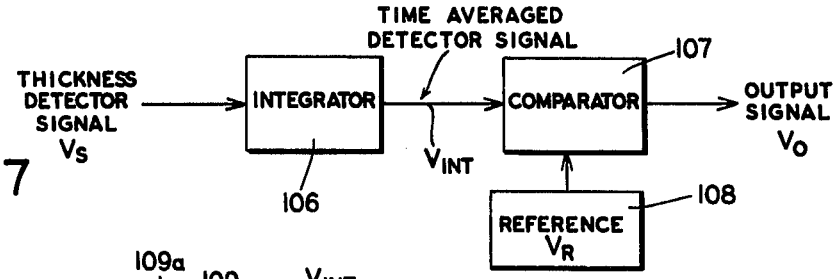
FIG.17
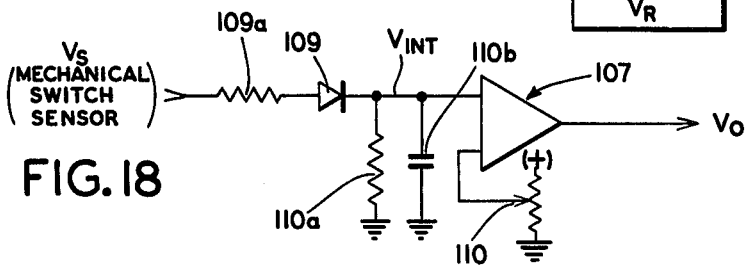
FIG.18
FIG.19a
FIG.19b
FIG.19c
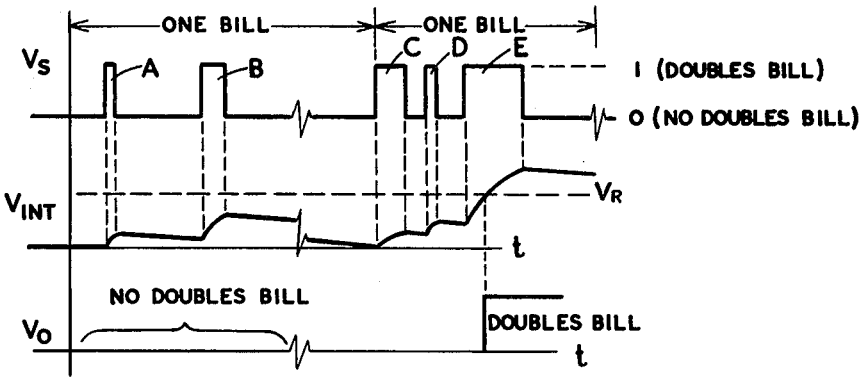
FIG.20
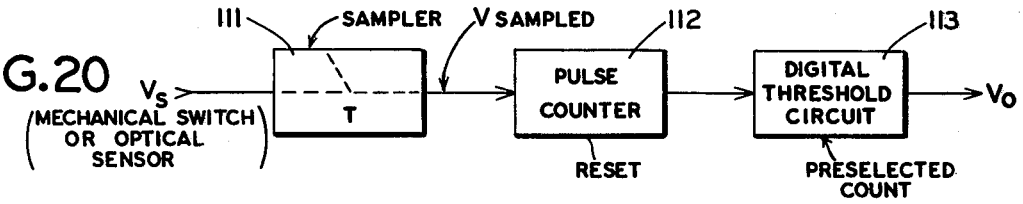
FIG.21a
FIG.21b
FIG.21c
FIG.21d
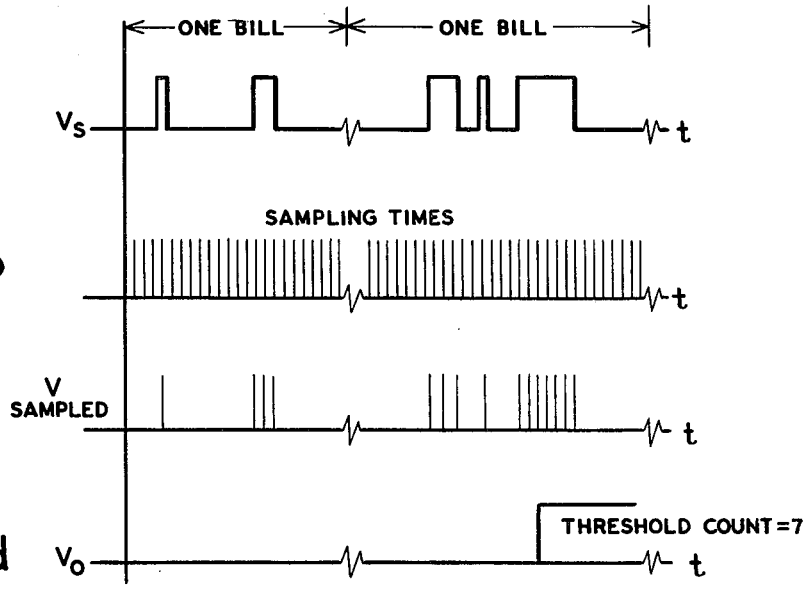

MULTIPLE BILL DETECTOR FOR CURRENCY DISPENSERS

BACKGROUND OF THE INVENTION

1. Field of the Invention

The invention relates to a detection system and mechanism for a currency dispenser which senses the presence of multiple or double bills at any bill location in a series of bills being fed lengthwise in a path of travel, one at a time, from a stacked currency supply to a customer access delivery receptacle of automatic banking equipment.

More particularly, the invention relates to a system and mechanism which gauges the thickness of bills moving in the path of travel, and time averages the gauged measurements along substantially the entire length of the gauged portion of each bill to indicate averaged thickness and to generate a signal indicating whether multiple or double bills, rather than a single bill, are present at any bill location in the series of moving bills.

Also, the invention relates to a detector and system in which the bill thickness gauging is performed mechanically or by light or photosensitive sensor means to generate the signal indicating the occurrence of multiple or double bills, herein called "doubles."

2. Description of the Prior Art

A variety of means have been used in the past for detecting characteristics of paper money or currency bills or other documents being conveyed from place to place in a line or path of travel and fed in a series one by one along the path of travel for counting the bills or documents, for sensing an overlapped relationship of successive documents, or for sensing the presence at any bill location of doubles.

Spring-biased levers, roller switches, photoelectric sensors and other similar devices have been used for these purposes. Examples of bill counters or dispensers are in U.S. Pat. Nos. 3,077,983, 3,168,644, 3,578,315, 3,760,158, 3,767,080, 3,937,453, 3,675,816, and 3,731,916. These prior devices substantially instantaneously generate a signal of the existence of the condition being sensed. In the case of the series of paper money bills being fed, the prior signaling of doubles is triggered immediately whenever the light beam of the photoelectric sensor is attenuated to a degree greater than that representing the thickness of a single bill.

Such a signal may be triggered by the presence of dirt or an inkspot or other dark areas on the bill, or by a folded or small thickened area of the bill anywhere along the bill zone being seen by the sensor, and without the actual presence of doubles. In effect, where currency is being dispensed, such prior detectors may be said to be too sensitive.

Since color, shades of color and variation in thickness of currency thus may trigger such prior photoelectric detectors to produce a doubles signal when doubles actually are not present, problems have arisen which render prior doubles detector devices unsatisfactory for simple, ready, efficient or proper control and handling in automatic banking equipment, for currencies of a number of countries where numerous bill colors for the same bill denomination are used, as well as for handling bills having variable opacity due to variable degrees of color or thickness.

Similar problems also are involved in handling a mixture of new and old paper money bills in such banking equipment, since certain characteristics of old money may differ from those of new money, producing different sensor signals for old as compared to new bills, with one or a given sensor adjustment.

Stated another way, prior doubles detection in currency dispensers has involved looking at a bill at one point; and if it appears thicker, the bill with be rejected as a doubles.

Thus, there exists a need for a doubles detector and system for currency dispensers which permits both new and old bills to be used and intermixed in the currency supply from which currency is dispensed; and also for a detector and system which is not affected by bill color, or changes in color or degree of color, or small bill areas of greater than normal bill thickness.

Further, there exists a need for a doubles detector and system for currency dispensers for automatic banking units which eliminates the stated difficulties or undesirable characteristics encountered in the construction, operation or use of prior devices.

SUMMARY OF THE INVENTION

Objectives of the invention include providing a currency dispenser for automatic banking equipment with detector mechanism which senses the presence of doubles at any bill location in a series of bills being moved and intended to be fed one by one in a path of travel from a supply of bills to a customer access delivery receptacle by time averaging the bill thickness of each bill over substantially the entire length of portions of such bill continuously gauged while moving in the path of travel; providing such doubles detector mechanism which utilizes a time-averaged bill thickness determination that exceeds normal bill average thickness by a predetermined amount to signal the presence of doubles and to reject such doubles before delivery to a customer delivery receptacle; providing such doubles detector mechanism which readily and efficiently performs a doubles detection operation on paper money bills fed one by one in a path of travel from a paper money bill supply which may include a random mixture of old and new paper money bills; providing such doubles detector mechanism which operates efficiently to detect and reject bills as doubles intended to be fed at spaced intervals one by one in a path of travel that accidentally are abutted end to end or edge to edge or are slightly overlapped even though such bills are not in the usual doubles relation of one bill on top of or stuck to another; providing such doubles detector mechanism which may be operated efficiently for the intended purpose whether the bills as fed in a path of travel are fed lengthwise one by one or crosswise one by one; providing such doubles detector mechanism which may be associated and operated in multiples of two or more detector units for dispensing two or more denominations of bills and in which the bills are fed one at a time from one dispenser unit and then one at a time from another dispenser unit to a common customer delivery receptacle; providing such doubles detector mechanism which conveys the bills by driven roll conveyor means past the doubles detecting gauging station and then to reversible driven flexible belt conveyor means which conveys the bills to the customer delivery receptacle, or which rejects the bills from the path of travel when doubles are detected; providing such doubles detector mechanism in which the flexible conveyor belt means may also serve as conveyor means for material deposited into the automatic banking equipment; providing such doubles detector mechanism which may include either mechanical or photosensitive means for gauging continuously the thickness of each bill successively moved past the thickness gauging station; providing such doubles detector mechanism which may reliably and effectively gauge paper money bill thickness variations of from 1/17 to 1/7 of the normal bill thickness; providing such doubles detector mechanism which may accept bills fed one by one from any desired type of stacked currency or paper money supply or container means for such currency supply; providing such doubles detector mechanism which may accept paper money bills fed one by one from any type of currency supply by any desired type of picker mechanism which removes the bills one by one from the supply and feeds the bills one by one to the doubles detector mechanism; providing such doubles detector mechanism which discharges doubles, when detected, from the belt conveyor means to rejected bill container means, which container means is removable from the currency dispenser, and preferably is locked during the act of removal; providing such doubles detector mechanism which readily accepts currencies of various countries of differing types of colors, thicknesses, etc., and performs the doubles detection operation regardless of or unaffected by such colors, shades of color and variations in thickness sometimes present in such foreign currency to effectively detect the presence of doubles; providing a new doubles detector system incorporating the principles of and steps of operation set forth; and providing new doubles detector mechanism and system which achieve the stated objectives in a reliable, effective, easily serviced, and secure manner, and which solve problems and satisfy needs that have existed in the field of currency dispensers for automatic banking equipment and systems.

These and other objects and advantages may be obtained with the new doubles detector mechanism for currency dispensers, the general nature of which may be stated as including in an automatic banking unit of the type in which currency in the form of paper money bills is delivered in requested amounts from a supply stack maintained under protective conditions in the banking unit from the supply to a customer access delivery receptacle, and in which the bills move one by one in a path of travel from the supply stack to the delivery receptacle normally at spaced intervals past the doubles detector mechanism; said mechanism including in combination, driven conveyor roll means receiving the bills delivered by picker mechanism which removes such bills from the supply stack one at a time; bill thickness gauging roll means including first and second spaced shafts, at least the first shaft preferably being rotatably driven and journaled on spaced support means and having a large diameter in cross section to provide shaft rigidity against bowing, the second shaft preferably being mounted non-rotatably on spaced support means and having a small diameter in cross section to permit shaft bowing flexibility, spaced pairs of opposed rolls mounted on the shafts, said rolls each including first and second rolls mounted on and rotatable with the first shaft, and third and fourth circular rolls mounted on the second shaft, the second shaft being slightly bowed to maintain the third and fourth rolls respectively in rolling contact with the first and second rolls, the circular third and fourth rolls preferably being bearings journaled on the second shaft, the flexibility of the second shaft permitting the second shaft bow to increase when a bill is conveyed in a path of movement by the driven first shaft between the contacting first and third and second and fourth rolls thereby radially moving the third and fourth rolls, respectively, away from the first and second rolls a distance equal to the thickness at the bite of the rolls of the bill conveyed between the rolls, first and second switch means, respectively, operatively engaged with the third and fourth rolls, one of the switch means being a counter switch and the other being a doubles detecting switch; reversible driven flexible belt conveyor means including flat platen means having delivery and reject ends and having a gate entry slot between its ends at a location spaced above the gauging roll means; guide means including separable guide members extending from the gauging roll means to said entry slot normally closing said slot, the guide members being separable by movement of a bill along the guide means between the guide members; an endless flexible belt above the platen trained around a pair of spaced belt support rolls, the belt support rolls being located, respectively, adjacent the delivery and reject platen ends, reversible motor drive means operatively connected to at least one of the belt drive rolls; the belt having an active flight movable along the platen and having an outer bill-engaging surface adjacent the platen and an inner surface; back-up plate means engaging the inner belt surface between the belt support rolls holding the active belt flight in bill-conveying contact against the platen to convey bills, that emerge from the guide means through the gate entry slot to a location beneath the active belt flight, in a normal forward path of movement toward the platen delivery end to deliver the bills from the bite between the belt and platen to a customer delivery receptable; the belt when its drive is reversed conveying a bill located between the active belt flight and the platen in a reverse direction, from the forward path of movement, across the gate entry slot to a bill reject container located adjacent the reject end of the platen; the doubles detecting switch means continuously gauging the thickness of each bill substantially throughout its length measured in the direction of travel as it is fed through the gauging roll means; circuitry connected with the doubles detecting switch means operative to time average the gauge measurements made throughout the gauged length of each such bill to provide an averaged measurement of bill thickness, and operative to compare the averaged measurement with an arbitrarily selected predetermined value equal to or greater than normal bill average thickness and to provide a doubles signal when such averaged measurement is greater than the arbitrary selected predetermined value, and also operative to reverse the belt conveyer drive upon the generation of said doubles signal.

BRIEF DESCRIPTION OF THE DRAWINGS

Preferred embodiments of the invention—illustrative of the best modes in which applicants have contemplated applying the principles—are set forth in the following description and shown in the drawings and are particularly and distinctly pointed out and set forth in the appended claims.

FIGS. 17 through 25 are schematic wiring diagrams for several doubles detection control circuits.

Similar numerals refer to similar parts throughout the drawings.

DESCRIPTION OF THE PREFERRED EMBODIMENTS

In General

Figure 1:
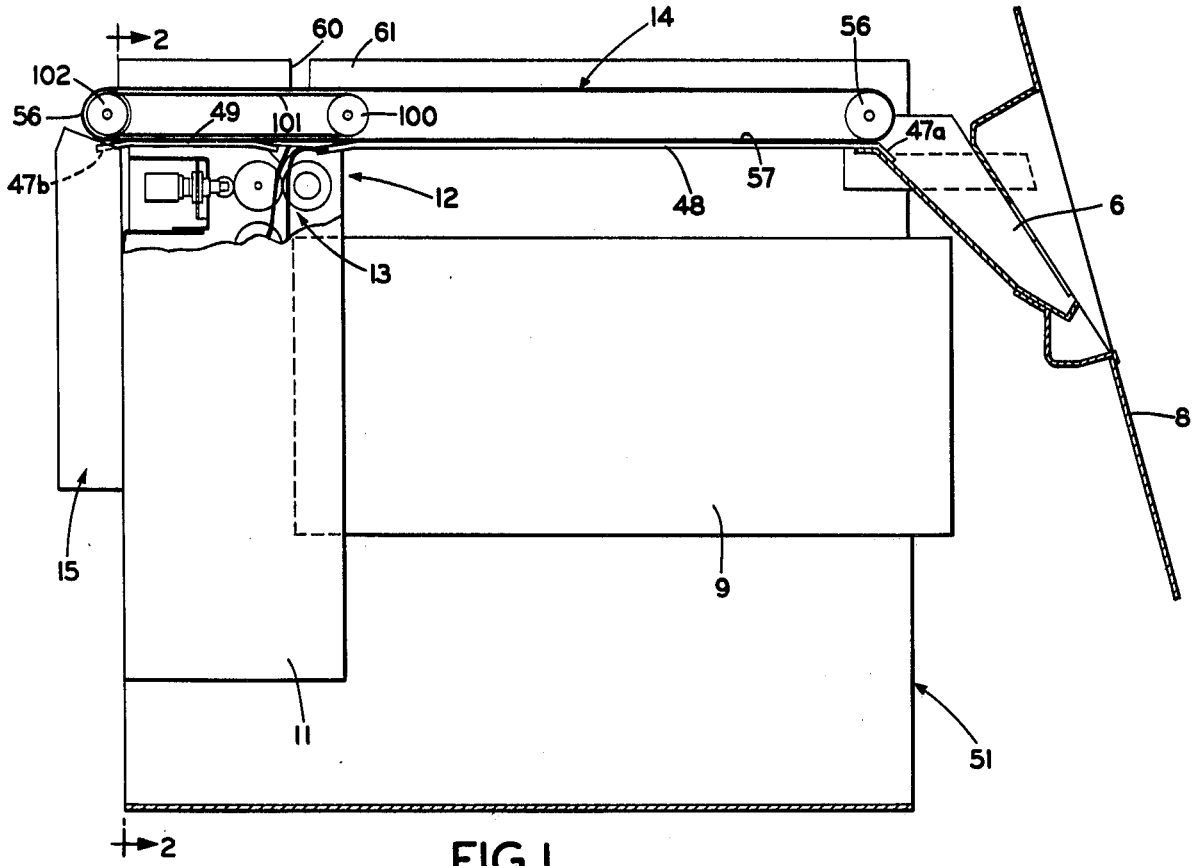
FIG. 1 is a diagrammatic view illustrating certain components of automatic banking equipment provided with currency dispenser means equipped with the improved doubles detector mechanism.

Fundamental characterizing conceptual features of the invention common to all embodiments of the new doubles detector and system include continuously or repeatedly sensing, measuring or gauging the thickness of each bill substantially throughout its length measured in the direction of travel as it is fed in a path of travel from a stack supply of bills to a place of delivery to a customer; time averaging the gauge measurements made throughout the gauged length of each such bill during thickness gauging to provide an integrated or averaged measurement of bill thickness, then comparing such averaged measurement with the normal bill average thickness or with an arbitrarily selected value greater than normal bill average thickness, so that when the averaged measurement is greater than the normal bill average thickness or selected value, a signal is generated indicating that a doubles is present rather than a single bill; and using such signal to reject the doubles from the path of travel before the doubles reaches the place of delivery to a customer.

In every embodiment, where two bills are abutted end to end or edge to edge or are slightly overlapped when passing through the gauging operation, the time averaging which extends over a greater length than the length or width of one bill produces a signal which rejects both bills, even though such bills are not in the usual doubles relation of one bill on top of or stuck to another. Such abutted or overlapped bills, however, also are included when the term "doubles" is used herein.

It has been indicated that gauge measurements of thickness of each bill are made continuously substantially throughout the length of each bill, or lengthwise thereof. The use of the term "lengthwise" refers to the manner in which the average thickness is determined and not as requiring lengthwise feed of the bill. That is, the bills may be fed in a path of travel with the bills extending crosswise of the direction of travel, and the continuous gauging occurs across the bill.

It is preferred to feed the bills lengthwie one by one rather than crosswise one by one because crosswise feed increases the width of the banking unit. This banking unit width is increased more if two or more different denominations of bills are dispensed side by side from the supply stacks of such different denomination bills. However, it is desirable to provide minimum width banking units which thus favors lengthwise bill feed.

Normally, in prior systems for detecting doubles, approximately a 10% portion of each end or edge of a bill in relation to the direction of bill travel is ignored in sensing the bill thickness because used bills may have frayed ends or edges or little corner folds, etc., which present bill portions that should not be taken as a basis of accurate thickness measurements.

For these reasons, among others, in accordance with the invention, the continuous thickness gauging occurs throughout at least 80% of the central portion of the bill measured in the direction of bill travel. Such 80% measurement zone is comprehended when referring to gauging "substantially throughout the bill length measured in the direction of travel."

The various comments made are applicable to each dispenser line for each bill denomination. When bills of two or more denominations are to be dispensed, there is a dispensing line, unit or mechanism for each bill denomination. In each line, the bills are fed one at a time. The separate lines preferably are located side by side in the banking equipment to simplify the construction and operation of the equipment. Thus, certain of the detector components are shared by all of the dispenser lines, such as shafts, drive means, etc.

Figure 3:
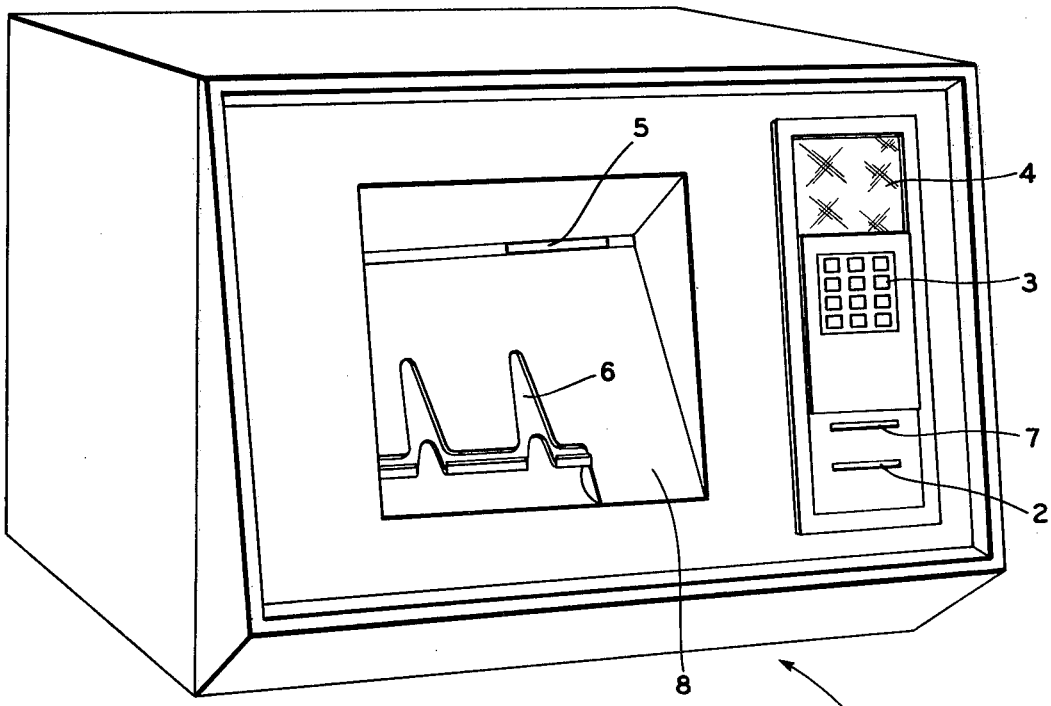
FIG. 3 is a somewhat diagrammatic perspective view of an automatic banking unit provided with currency dispenser means equipped with the new doubles detector mechanism.

A typical automatic banking unit for dispensing currency in response to the presentation by a bank customer of coded card means is diagrammatically illustrated at 1 in FIG. 3. Such units may be energized when a customer presents or enters a coded card into slot 2. The coded card is verified to confirm that it is an authorized card and that the user thereof is the authorized user through a card reader and other known devices contained in the unit 1 or electrically connected thereto.

After the card and customer verification has been carried out, keyboard entires may be made by the customer at 3 in accordance with instructions presented to the customer at instruction panel 4. The entries among other matters may indicate the amount of currency that the customer desires to withdraw, or may indicate that the customer desires to make a deposit.

A deposit may be made by entry of an envelope containing the deposit in deposit slot 5. If currency is to be dispensed, it may be delivered from mechanism within the unit 1 at the customer access bill delivery receptacle means 6. A record of or receipt for the transaction may in some instances be issued to the customer through receipt slot 7. The card entry slot 2, the keyboard 3, the instruction panel which may be a TV screen 4, the depository slot 5, the bill delivery receptacle 6, and the receipt slot 7 all are preferably formed in or carried by the recessed facia plate means 8.

Figure 2:
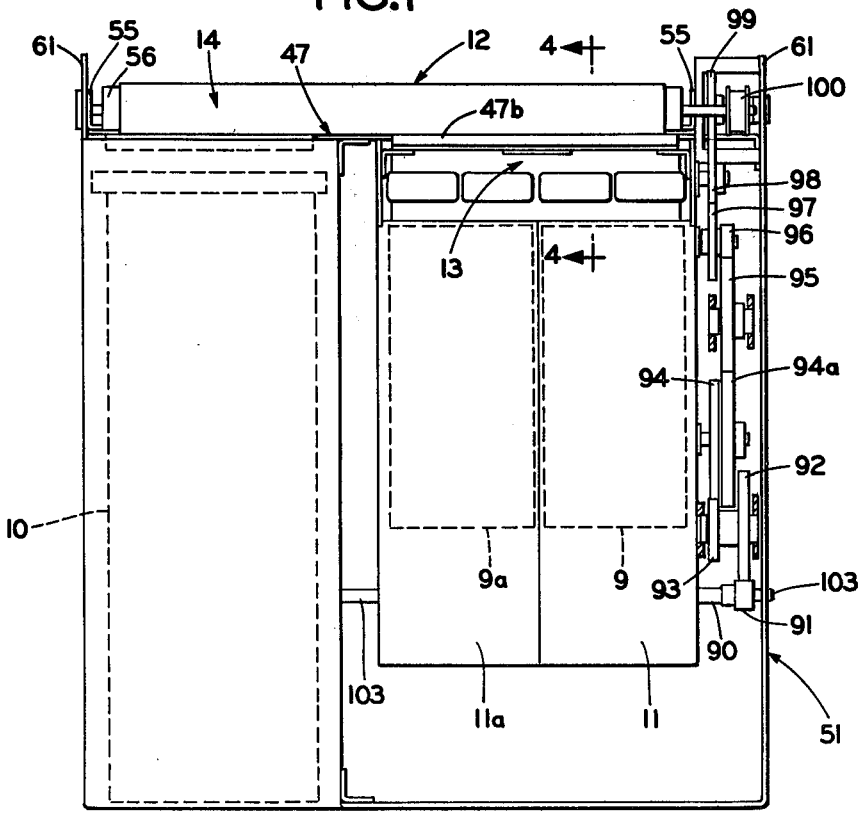
FIG. 2 is a diagrammatic view of certain of the parts shown in FIG. 1 looking in the direction of the arrows 2—2, FIG. 1.

Cash dispenser and depository components are generally diagrammatically illustrated in FIGS. 1 and 2 and may include a container 9 for a supply of paper money in the form of bills which may be a random collection of new and old bills in a stack protectively held in the container 9. The money supply container 9 may be of the type of Sealed Tamper-Indicating Money Dispensing Container For Automatic Banking Systems shown and described in the Graef et al application Ser. No. 761,288, filed Jan. 21, 1977, now allowed and assigned commonly to the assignee of this application, or it may comprise any other desired receptacle construction for containing a supply of stacked paper money bills.

Frequently, it is desired to provide for dispensing currency at automatic banking units in two denominations such as ten and one dollar bills, or twenty and five dollar bills. Accordingly, two paper money bill containers 9 and 9*a* are illustrated in FIG. 2 to satisfy such requirements. Containers 9 and 9*a* preferably are located side by side as shown. However, it is contemplated that any desired number of containers for currency of different denominations, say one to three or four containers can be present in an automatic banking unit and located side by side as generally indicated by the two containers 9 and 9*a*.

Frequently, it is desired to provide a depository component in an automatic banking unit. The general location of such a depository component is indicated at 10 with which the deposit slot 5 of FIG. 3 communicates. The side by side arrangement of the currency supply containers 9, 9*a* and of the depository unit 10 has special cooperative advantages in accordance with certain aspects of the invention described below.

Each bill supply container 9 or 9*a* has its own associated picker mechanism 11 or 11*a* (FIGS. 1 and 2). Again, any desired picker mechanism for picking paper money bills one at a time from a stacked supply and for feeding the same, bill by bill, to other components of a banking system may be used.

The improved doubles detector mechanism operates automatically to reject doubles and a rejected bill container to receive the doubles that are rejected is indicated generally at 15 in FIG. 1, but is removed for clarity from FIG. 2.

First Embodiment

The improved doubles detector mechanism is generally indicated at 12 in FIGS. 1 and 2 and generally includes bill thickness gauging means generally indicated at 13 and reversible driven flexible belt conveyor means generally indicated at 14.

Figures 4, 5, 6:
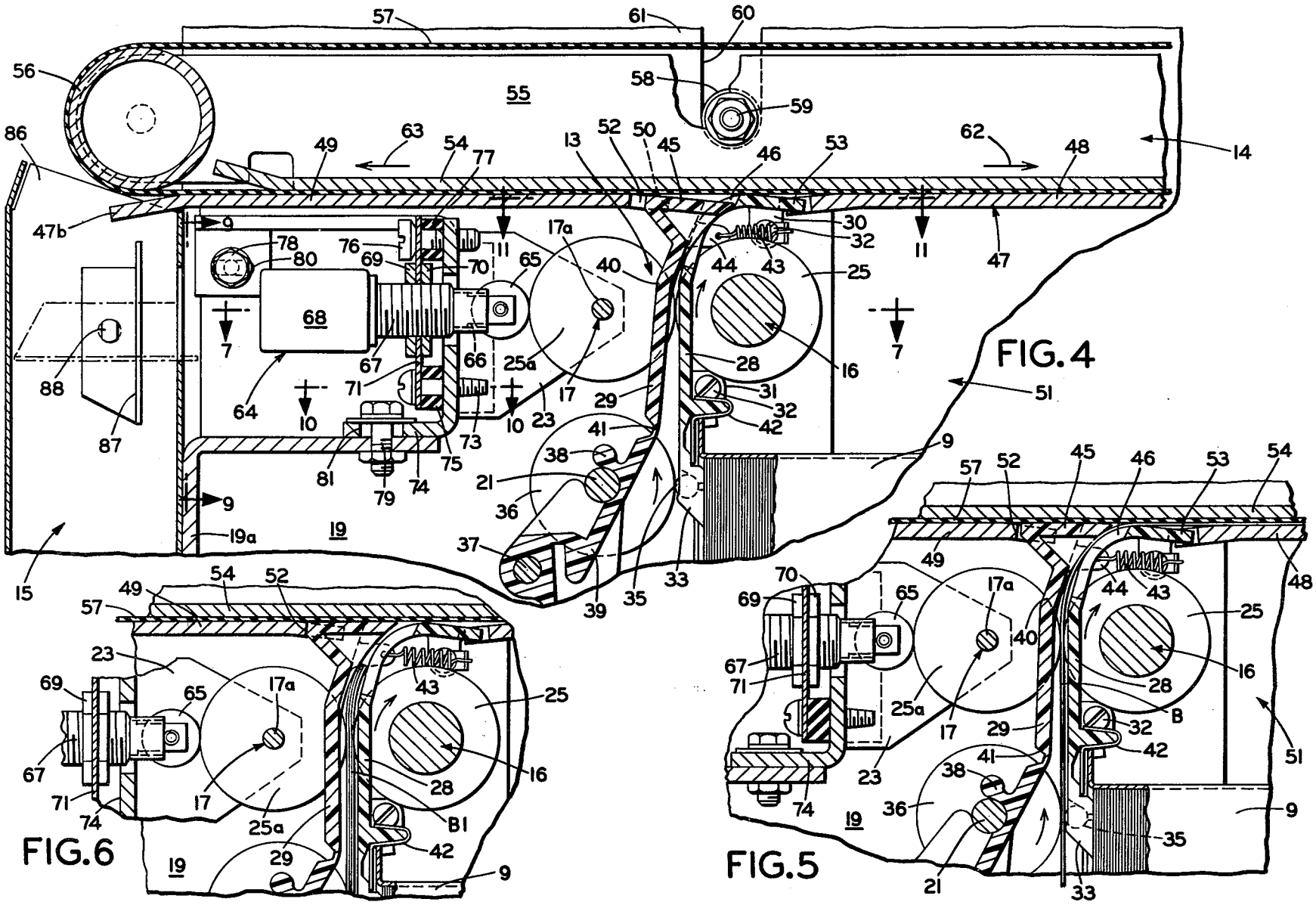
FIG. 4 is a greatly enlarged fragmentary sectional view of certain of the parts shown in FIG. 1 taken in section on the line 4—4, FIG. 2, illustrating the bill thickness gauging roll means and doubles detecting switch, with no paper money bill passing between the rolls of the gauging roll means.
FIG. 5 is a view similar to FIG. 4 illustrating the bill thickness gauging roll means actuated by the passage of one bill between the gauging rolls.
FIG. 6 is a view similar to FIGS. 4 and 5 showing a large number of bills, one on top of another, accidentally fed to the gauging rolls.

In the embodiment of the invention shown in FIGS. 1 through 15, the bill thickness gauging means 13 has roll pairs and switch means for continuously gauging the thickness of bills passed between the rolls, well shown in FIGS. 4, 5 and 6.

The roll gauging means, as shown, includes shafts generally indicated at 16 and 17 mounted on side walls 18 and 19 of the housings for picker mechanisms 11 and 11*a*.

Figure 7:
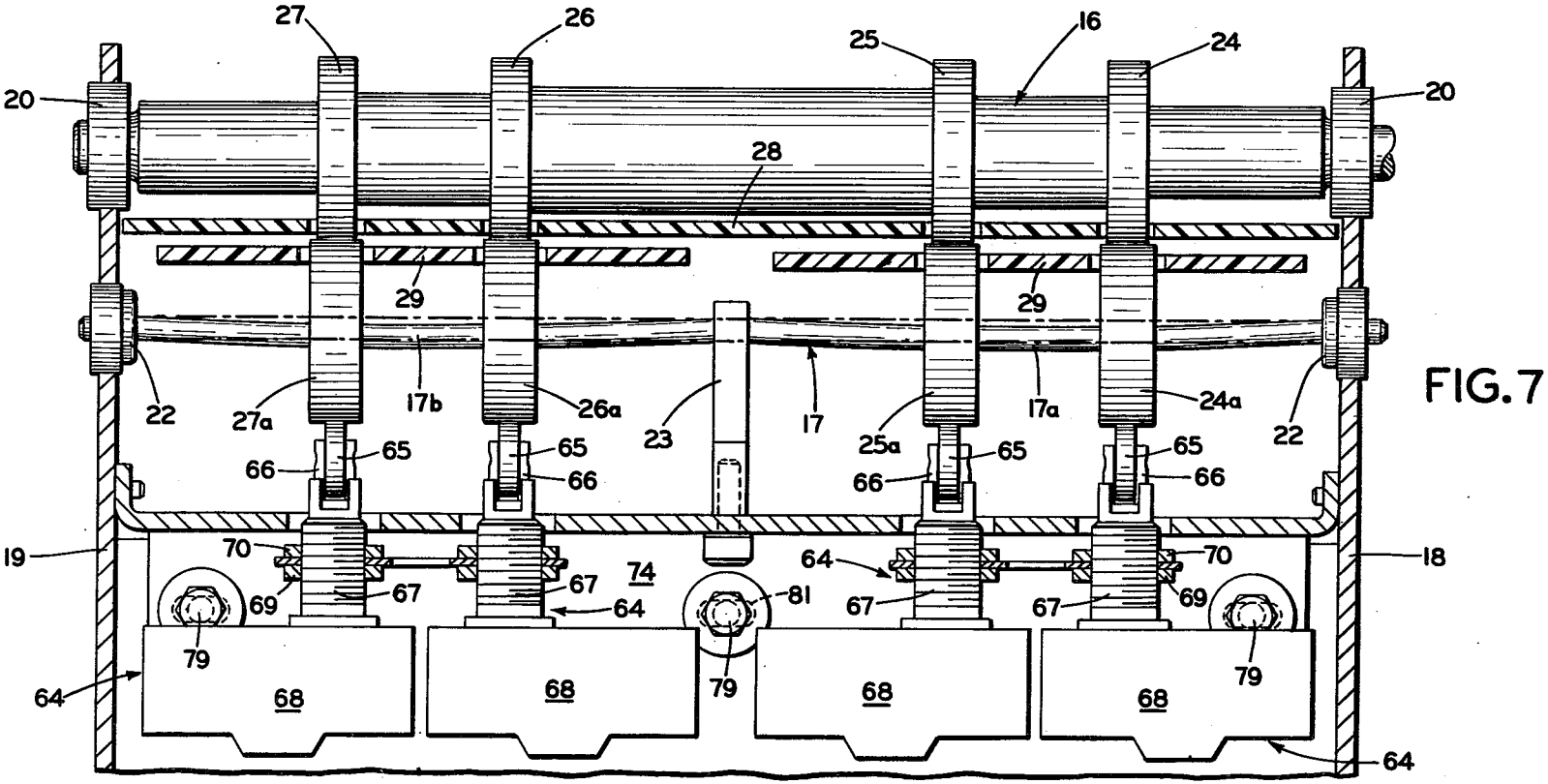
FIG. 7 is a fragmentary plan sectional view taken on the line 7—7, FIG. 4, through the gauging roll axes, illustrating the gauging rolls awaiting passage of bills between the rolls.

Referring to FIG. 7, the shaft 16 is journaled at its ends in bearings 20 for rotation in synchronism with picker mechanism conveyer roll shaft 21 also journaled in the picker mechanism housing and located below gauging roll shafts 16 and 17.

The gauging shaft 16 has a large diameter in cross section to provide shaft rigidity against bowing; while the gauging shaft 17 has a small diameter in cross section to permit shaft bowing flexiblity. The shaft 17 is mounted non-rotatably in end supports 22 on picker walls 18 and 19 and is also supported midway its ends on a support member 23 for a purpose to be described (FIG. 8).

Shaft 16 has a pair of spaced rolls 24 and 25 thereon near to picker side wall 18 and has another pair of spaced rolls 26 and 27 near to picker side wall 19. A pair of spaced rolls 24*a* and 25*a* is mounted on the shaft portion 17*a* of shaft 17 which extends between wall 18 and mid support 23. Another pair of spaced rolls 26*a* and 27*a* is mounted on the shaft portion 17*b* of shaft 17.

The rolls 24*a*, 25*a*, 26*a* and 27*a* preferably comprise antifriction bearings having circular outer contours and journaled on the shaft portions 17*a* and 17*b*. The bearing rolls 24*a* and 25*a* are normally in rolling contact with rolls 24 and 25, respectively, and serve money supply 9 and picker 11. Similarly, bearing rolls 26*a* and 27*a* are normally in rolling contact with the rolls 26 and 27, respectively, and serve money supply 9*a* and picker 11*a*.

Figure 8:
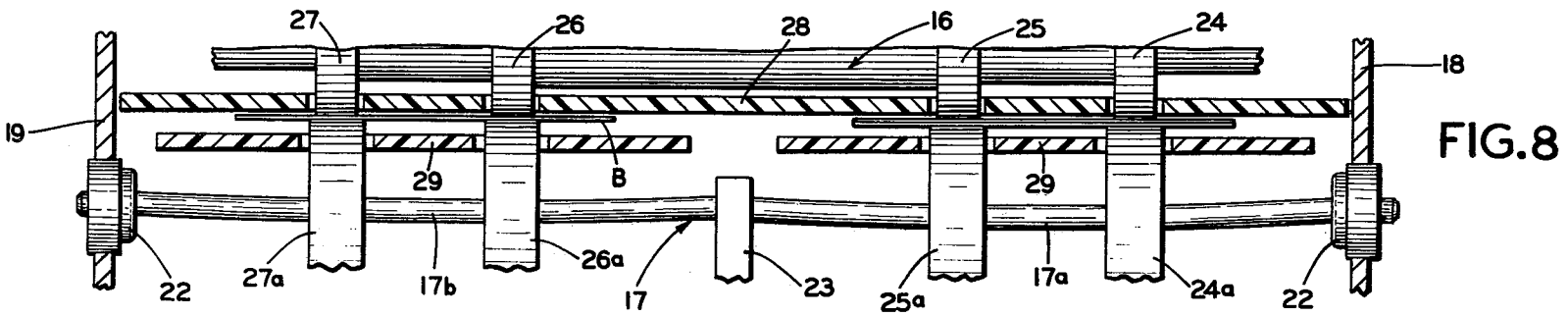
FIG. 8 is a fragmentary view similar to FIG. 7 illustrating a single bill passing between one set of gauging rolls, and a doubles condition of two bills passing between another set of gauging rolls.
Figure 10:
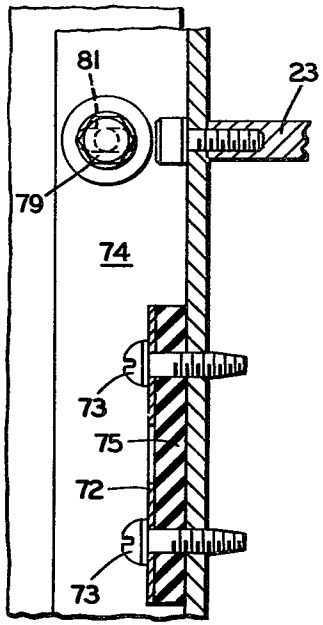
FIG. 10 is a sectional view taken on the line 10—10, FIG. 4 and 10—10, FIG. 9.
Figure 9:
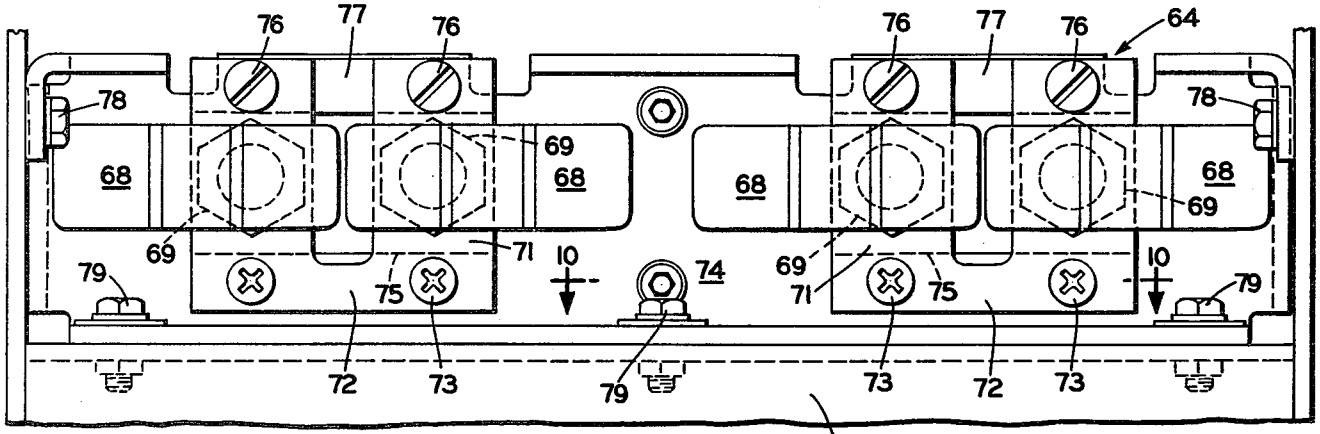
FIG. 9 is a fragmentary elevation sectional view looking in the direction of the arrows 9—9, FIG. 4.

The pairs of spaced contacting rolls 24, 25, 24*a* and 25*a* thus form two pairs of gauging rolls between which a paper money bill from supply unit 9 may be conveyed, as shown at B in FIGS. 5 and 8. Similarly, the pairs of gauging rolls 26, 27, 26*a* and 27*a* serve the money supply 9*a*.

The fixed supports 22 and 23 for the thin shaft portion 17*a* are so located with respect to the axis of the shaft 16 that when the parts are assembled and the bearing gauging rolls 24*a* and 25*a* are in rolling contact with the rolls 24 and 25, respectively, on shaft 16, the shaft 17*a* assumes a slight bow as shown in full lines in FIG. 7. The dot-dash lines in FIG. 7 adjacent the full line illustration of the shaft portion 17*a* illustrate the theoretical outline of shaft portion 17*a* if the shaft were straight and not subjected to the bowing pressure from the mounting illustrated and described.

The path of movement of bills through the doubles detector mechanism 12 from the picker mechanism 11 is generally defined by guide means which include separable guide members 28 and 29 preferably formed of molded plastic material imparting some flexibility to the guide members. Guide member 28 has ears 30 and 31 at its ends which are secured by screws 32 to the picker side walls 18 and 19 holding the member in a relatively fixed position.

Rectangular ears 33 project downwardly from the lower portion of fixed guide member 28 (FIG. 13) having rounded pockets 34 formed therein. Needle-like rollers 35 are rotatably mounted in the guide member pockets 34 engaged by rubber drive rolls 36 carried by drive shaft 21. The drive shaft 21 acts as a conveyor feed shaft for the doubles detector mechanism to feed paper money bills B from the picker mechanism 11 to the gauging means 13 by imparting driving engagement to the bills B through the rubber drive rolls 36 pressing against the needle rollers 35, as shown for example, in FIG. 5.

The other guide member 29 of the guide means is mounted on a shaft 37 carried by the picker housing and has a keyhole portion 38 which snaps over the shaft 21 to support the lower portion 39 of member 29 in fixed position. The upper portion 40 of member 29 is flexibly movable with respect to the lower portion 39 about the zone 41 which acts as a pivot point for movement of the upper guide member portion 40.

There is a pair of rubber drive or feed rolls 36 for each bill feed line, one roll 36 opposite each needle roller 35, and the needle rollers 35 are biased against rubber rolls 36 by the leaf springs 42, the lower ends of which press the rollers 35 toward rolls 36.

As stated, the shafts 16 and 21 are driven in synchronism and rotate in the direction of the arrows shown in FIGS. 4 and 5 so that a bill B is conveyed in its path of travel between rolls 36 and 35 and between the detector rolls 24 and 24*a*, or 25 and 25*a*, etc., toward belt conveyor means 14 between the guide members 28 and 29. During the conveyor feed movement of the bill B (FIG. 5) upward between the guide members, the bill separates the upper portion 40 of the guide member 29 from the guide member 28, as shown. The flexibility of the guide member 29 and pivoting of upper portion 40 about pivot point 41 permits such separation, against the very light pull of a spring 43 connected with the picker housing and the ear 44 on the upper end of the upper guide member portion 40.

The upper end of upper portion 40 of guide member 29 has a series of spaced flange-like or comb-like teeth or projections 45 which project toward and into spaced openings 46 formed in the upper end of guide member 28, as shown in FIG. 4. As the bill B is fed between the guide members 28 and 29, the bill passes between the teeth 45 and the curved portion of the guide member 28 in which the openings 46 are formed, and upper guide portion 40 separates from member 28, as shown in FIG. 5.

The belt conveyor means 14 generally includes flat platen plate means 47 preferably comprising two plates 48 and 49 which are split at 50 (FIG. 4). Plate 49 is carried by the picker housing while plate 48 is mounted on top of the housing, generally indicated at 51, for the components illustrated in FIGS. 1 and 2.

The platen means 47 is formed between its ends with an entry slot generally indicated at 52, at a location spaced above the gauging means 13. The slot 52 preferably is formed at the location of the joint or split 50 between plates 48 and 49. The slot 52 has a sawtooth or spaced tooth-like contour to receive the various teeth or projections 45 on guide member 29 as well as similar tooth-like formations 53 at the upper extremity of guide member 28.

The interfitting teeth 45 and 53 in the slots or openings 46 and 52 present a continuous top surface for the platen means 47 when the guide means is closed as in FIG. 4, and except when guide members 28 and 29 are separated by the passage of a bill along its path of travel, as shown in FIG. 5.

The belt conveyor means 14 also includes a generally rectangular back-up plate 54 having side flanges 55 extending along the top of the platen 47. Belt support rolls 56 are journaled between and at the ends of the back-up plate flanges 55. An endless flexible, preferably rubber, belt 57 is trained around the support rolls 56 and has an active flight which extends below the back-up plate 54 and above the platen means 47.

The back-up plate 54 with rolls 56 and belt 57 assembled thereto comprise a box-like unit which rests on the platen means 47 but is movable up and down with respect to the platen means for a purpose described below. The position of this assembly during any such movement is indexed by roll guides 58 mounted by bolts 59 on and projecting outwardly of the back-up plate side flanges 55. The roll guides 58 are received in upwardly opening slots 60 formed in upstanding wall portions 61 of the main housing 51 (FIGS. 1 and 4).

The belt 57 has a reversible drive described below and its active flight normally is pressed against the platen 47 by the back-up plate 54 of the belt assembly. Thus, bills B fed between guide members 28 and 29 and through the entry slot 52, are supported by the platen means 47 and are conveyed or transported by the belt 57 normally in the direction shown by the arrow 62 in FIG. 4. The arrow 62 indicates the normal flow direction of movement of bills B in their path of travel from the guide members 28 and 29 to the bill delivery receptacle 6.

When the direction of belt movement is reversed, as indicated by the arrow 63 (FIG. 4), any bill supported on the platen means 47 is conveyed by the belt 57 in the direction of the arrow 63, in response to the detection of doubles by operation of the doubles detector mechanism described below. Any bill B that is conveyed by the belt in the direction of the arrow 63 is discharged from the belt conveyor into a rejected bill container 15 which is removably supported by any suitable means on one of the walls 19*a* of the picker housing.

Thus, any bill that emerges from the guide means through the entry slot 52 always moves to a location beneath the active belt flight in a normal forward path of movement toward the platen delivery end 47*a* in the direction of the arrow 62 during normal forward drive movement of the belt. When the direction of movement of the belt is reversed by the detection of doubles, any bill or bills B located between the active belt flight and the platen 47 to the right of the entry slot 52 will be conveyed in a reverse direction from the normal forward direction of movement, across the gate entry slot 52 which is closed, to the bill reject container 15 which is located adjacent the reject end 47*b* of the platen means 47.

The initial slight bow of the shaft portions 17*a* and 17*b* for maintaining the bearing gauging rolls 24*a* to 27*a* in contact with the thick shaft rolls 24 to 27 has been described as shown in FIG. 7. The left-hand portion of FIG. 8 shows the normal bowing of shaft portion 17*b* by movement of a single bill B between the pairs of gauging rolls 26–27 and 26*a*–27*a*; while the right-hand portion of FIG. 8 illustrates the thin shaft portion 17*a* bowed further by two bills, or a doubles condition, passing between the pairs of gauging rolls 24–25 and 24*a*–25*a*.

The doubles detector mechanism 12, in addition to the gauging rolls, also includes switch means 64. One switch means 64 is associated with and actuated by each opposed pair of gauging rolls 24–24*a*, 25–25*a*, etc. Each of the switch means may be a plug, button or roller displacement-type switch. A roller switch is preferable as illustrated.

Each switch 64 includes a roller 65 mounted on a plug 66 movable axially in a barrel 67 to actuate make and break contacts contained in the switch housing 68. The barrel 67 is locked by nuts 69 and 70 on a thin flexible plate portion 71 of a U-shaped mounting plate 72. Plate 72 is mounted by screws 73 on a mounting angle 74 carried by the picker housing. Preferably, a rubber pad or gasket 75 is interposed between the plate 72 and member 74. The upper ends of the plate portions 71 are clamped by adjusting screws 76 to the mounting angle member 74 against the pressure of rubber pad 77.

Thus, adjustment of any screw 76 enables the relative position of any switch 64 with respect to its gauging roller **24*a*** to be accurately adjusted.

Mounting angle 74 provides the mounting for all four of the switch means 64. The position of mounting angle 74 with respect to the gauging roll means may be generally adjusted to and away from the gauging means 13 (FIG. 4) by adjustment of the position of the bolts 78 and 79 in slots 80 and 81 in the mounting angle 74.

The normal average thickness of a bill B of United States currency is 0.0035". The degree or effective accuracy of mechanical multiple bill switch gauging is related to the sensitivity of the switch that gauges bill thickness in excess of normal thickness. The switch may have a differential travel range of from 0.0002" to 0.0005" movement from its operating point to its reset point for actuation after movement from its normal position. This differential travel range provides for gauging variations in bill thickness of 1/7 of the thickness where the switch has an 0.0005" differential travel characteristic. With a more sensitive switch having an 0.0002" differential travel characteristic, a thickness variation of 1/17 of the normal bill thickness may be gauged.

Accordingly, the mechanical bill thickness gauging technique concept of the invention provides an extremely critical control for the detection of doubles. Further, where the switch is initially very sensitive with an 0.0002" differential travel characteristic, if this characteristic changes in use to a 0.0005" differential travel value, the switch still will detect a bill thickness variation of 1/7 of the normal bill thickness.

Further, switch means 64, particularly of the roller switch-type shown, may incorporate a large degree of overtravel which will accommodate an overtravel condition resulting from the accidental feed through the doubles detector mechanism of a large number of bills in one pack, such as ten or more bills, indicated at B1 in FIG. 6, which might have been stapled together. The ability to accommodate such a condition by switches having a large degree of overtravel prevents the doubles detector mechanism from being jammed or damaged upon the accidental occurrence of the condition shown in FIG. 6 wherein the bills B1 will pass to the conveyor and will be rejected as doubles.

An individual switch means 64 is actuated one each by each of the pairs of gauging rollers **24–24*a*, etc. As shown, there are two switch means 64 for each bill denomination dispense line. One of the switch means 64, for the gauging roll pair 24–24*a* may be used to accomplish a counting function to count the number of bills being gauged. The other switch means of a pair of switch means for said dispense line, for example, the switch 64 for the pair of gauging rolls 25–25*a*** is the doubles detecting switch for that bill dispensing line.

As previously described, each of the switch means 64 is provided with very sensitive adjusting means and as one or more bills pass between the gauging rollers, the bow in the thin shaft portion **17*a* or 17*b* is increased, depending upon the thickness of the particular bill or bills. The switch means 24** detect the amount of switch movement continuously which thus continuously measures the thickness of the bills passing through the detector.

Where the banking unit 1 is designed to supply bills of say two different denominations from separate supplies of different denomination bills as described, a separate or individual doubles detector mechanism must be provided for each dispensing line. Two such lines are illustrated in FIGS. 7 and 8 and under such circumstances common shafts and other common components may be used for the two lines as shown to serve the doubles detector mechanisms for each of the currency dispenser lines.

The bowed-shaft concept of mechanically roller gauging bill thickness continuously requires the thin shaft 17 to have a separate shaft portion for each dispenser line, and this is accomplished by using one shaft 17 for the two lines and supporting the shaft at its midpoint by the midsupport member 23.

Figure 15:
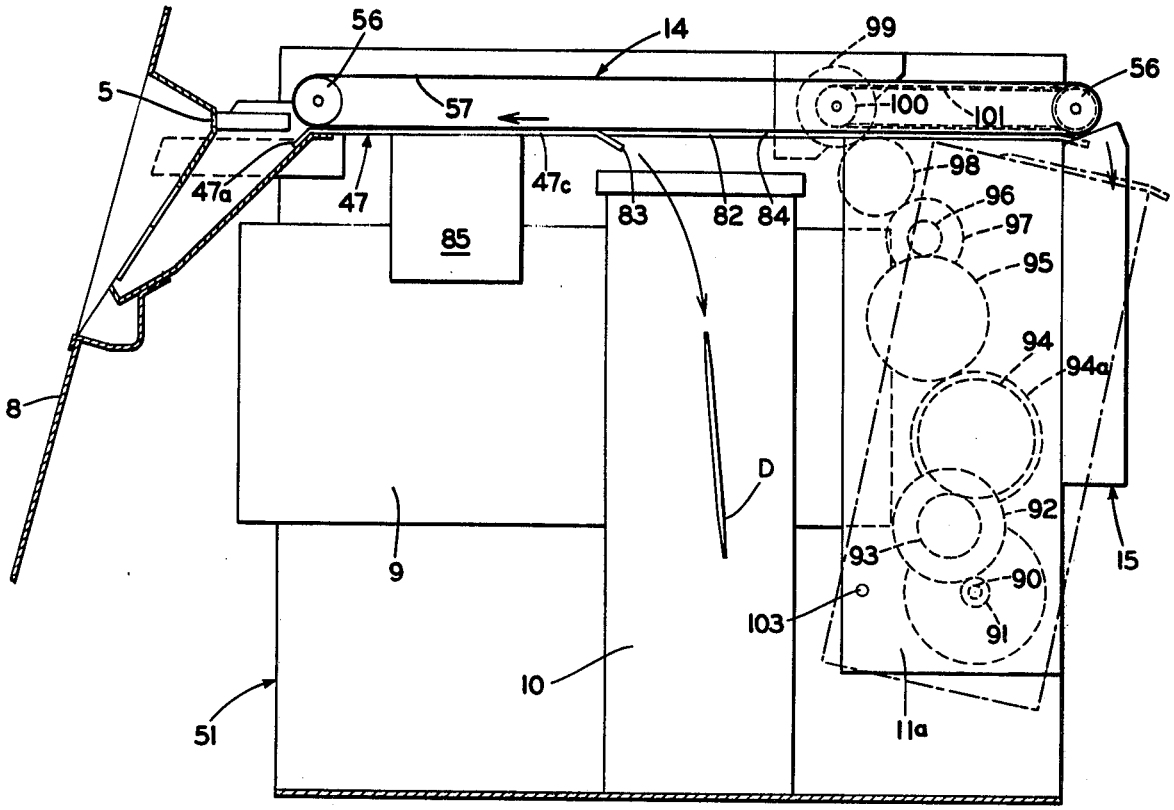
FIG. 15 is a view similar to FIG. 1, looking at the equipment from the other side.

In accordance with the invention, the banking unit 1 may include a depository section 10 (FIGS. 2 and 15) and the belt conveyor 57 cooperating with the platen means 47 acts as a means of receiving and conveying deposited material entered into the unit through the deposit slot 5 (FIG. 3) which is aligned with the platen delivery end **47*a* of the belt conveyor platen 47 (FIG. 15**).

The platen means 47 (FIG. 2) extends laterally over the doubles detector mechanisms for both of the two dispense lines and also across the top of the depository 10. From the platen delivery end **47*a*, the platen portion extending over the depository 10 discharges through a wide slot 82 having edges 83 and 84, the deposited material which drops as indicated at D into the deposit compartment of depository 10**.

A printer mechanism of usual construction and operation may be mounted at 85 within the depository 10 and below platen portion **47*c*** to identify deposited material being received. The deposited material D is conveyed by the belt conveyor into the unit by reverse movement of the belt which is initiated for a depositing operation by depository actuation means which the customer is directed to operate.

This facet of the inventive concept materially simplifies the construction and cost of manufacture of banking units which combine cash dispensing and depositing, since the cash dispensing conveying means—the belt 57 and related platen and other components—are also used as the depository conveyor. The provision for up and down guided movement of the conveyor belt assembly (roller guides 58 and open slots 60) permits the conveyor belt 57 to raise and accept thick deposit packages D.

Figure 14:
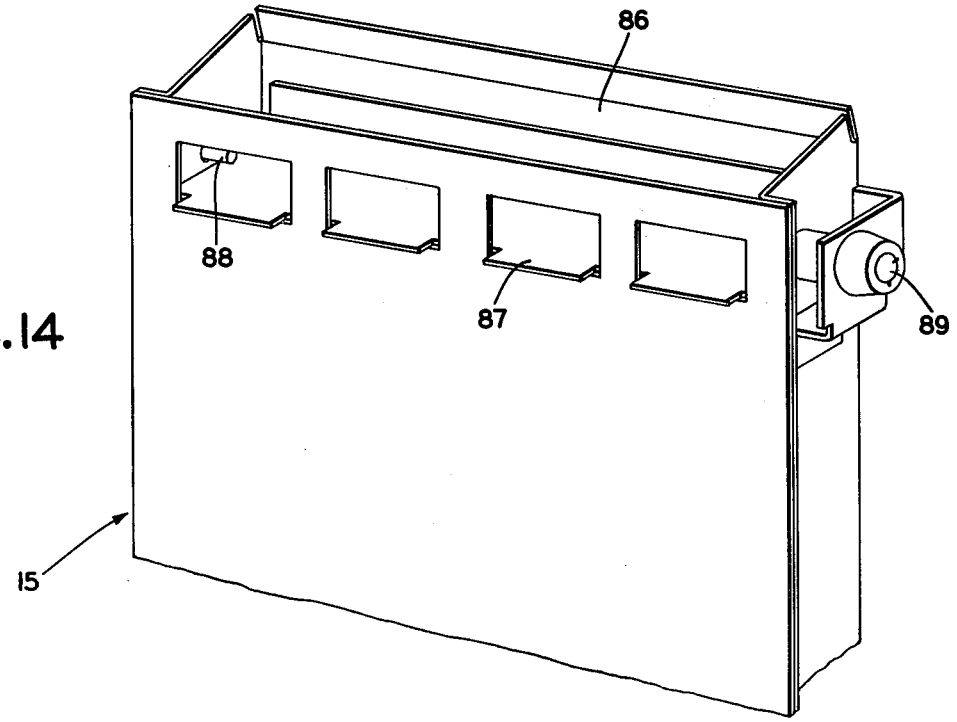
FIG. 14 is a fragmentary perspective view of the rejected bill container.

The rejection of doubles when detected has been described, accomplished by reversing the conveyor travel to convey the rejected doubles to the rejected bill container 15 shown in FIG. 14. This container, as previously stated, may be detachably connected to the picker housing adjacent the reject end **47*b* of platen means 47. Container 15 is a five-sided box-like structure with an open mouth 86 at the top adapted to receive rejected bills discharged from the belt conveyor means. Container 15 is removably mounted on the picker housing as shown generally in FIGS. 1, 4 and 15. It preferably is provided with a closure member 87 pivotally mounted at 88 and controlled by lock means 89, the key for which is retained by the picker mechanism and which must be in locked condition before the container 15** can be removed from the picker unit.

Such key retention protective arrangement for the rejected bill container 15 may be similar to that shown in said application Ser. No. 761,288 and which may be used in connection with the placement and removal of sealed money supply canisters 9 and 9a in automatic banking unit 1.

In accordance with the concepts of the improved doubles detector mechanism, and its coordination with other components of the banking unit 1, the belt conveyor means and the doubles detector mechanism may have a common drive means also common to the picker mechanisms associated with each currency dispensing line. This drive mechanism is shown diagrammatically in FIG. 15 and may comprise a main drive motor, not shown, having a drive shaft 90 which operates various elements of the picker mechanism through a gear train including gears 91, 92, 93, 94, 94a, 95, 96, 97, 98 and 99. The gears 96 and 97 are mounted on the shaft 21 for the rubber drive rolls 36. The gear 98 is mounted on the thick gauging shaft 16. The gear 99 is mounted on the rubber belt assembly on a stub shaft which also carries a belt drive pulley 100 which is connected by a drive belt 101 with a pulley 102 mounted on the belt support roll 56 at the reject end 47b of the belt conveyor.

The gears 97, 98 and 99 all have the same number of teeth so that the shafts on which they are mounted are synchronized in rotative movement so that the conveying feed imparted to any bill fed to the feed roll 36 and engaging rollers 35 is uniform throughout the path of travel of the bills to their ultimate destination.

For convenience in the control and operation of the improved banking unit 1, the sealed money supply canisters 9 and 9a preferably are of the type shown in said application Ser. No. 761,288. When they are installed in and removal from the banking unit 1, the picker mechanisms 11 and 11a must be moved out of the way. This may be accomplished by pivotally mounting the entire picker mechanism housing on a pivot 103. Pivotal movement of the picker housing, indicated in dot-dash lines in FIG. 15, carries with it the gearing 91 through 98, gear 98 being disengaged from gear 99 on the belt conveyor assembly. The platen portion 49 which closes the top of the picker housing also moves with the picker housing, thus separating the platen at the slot 52 and the dividing point 50.

In the foregoing description of the new doubles detector and system, a banking unit has been described which includes the depository 10 and two currency dispenser lines for dispensing currency of two different denominations from money supply canisters 9 and 9a. It is to be understood, however, that the operation of the new doubles detector mechanism is not dependent upon the presence of a depository in the banking unit or of a plurality of lines for dispensing two denominations of bills, since the doubles detector mechanism incorporating the concepts of the invention may be operated by feeding bills from a single money supply canister 9 through the medium of a picker 11 and from the doubles detector mechanism 12 to belt conveyor means 14.

However, the improved doubles detector mechanism and system has the significant advantage that a plurality of bill denomination feed lines and/or a depository unit, or both, may be integrally incorporated through common drives, etc. with the new doubles detector mechanism and system.

The thickness of any bill or doubles may be gauged in several manners. Thus far, the mechanism described essentially has been a mechanical thickness gauging mechanism. However, physical characteristics of a bill which may be used to gauge its thickness are its opacity or its ability to attenuate the transmission of light. A slightly modified form of gauging means for the new doubles detector mechanism and system involving the use of photosensitive thickness gauging is shown in the second embodiment described below.

Second Embodiment

Figure 16:
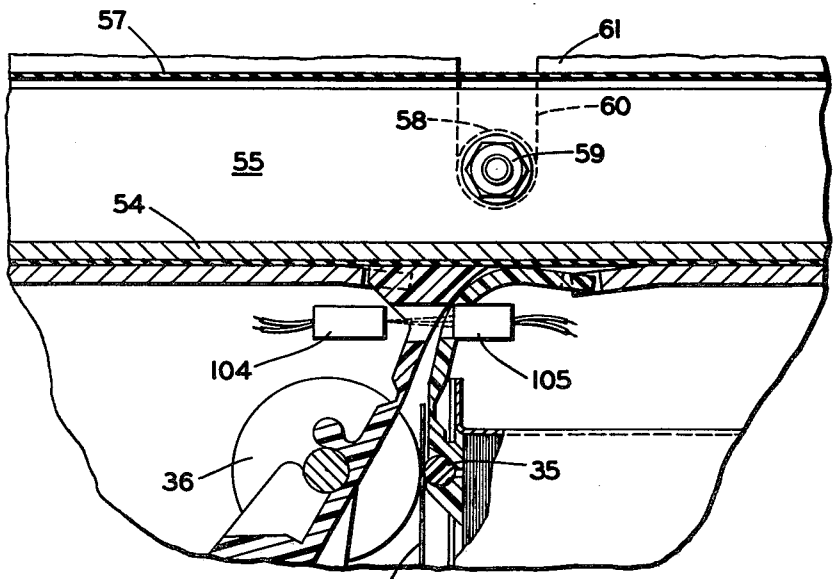
FIG. 16 is a view similar to FIG. 4 of a modified form of construction.
Figure 11:
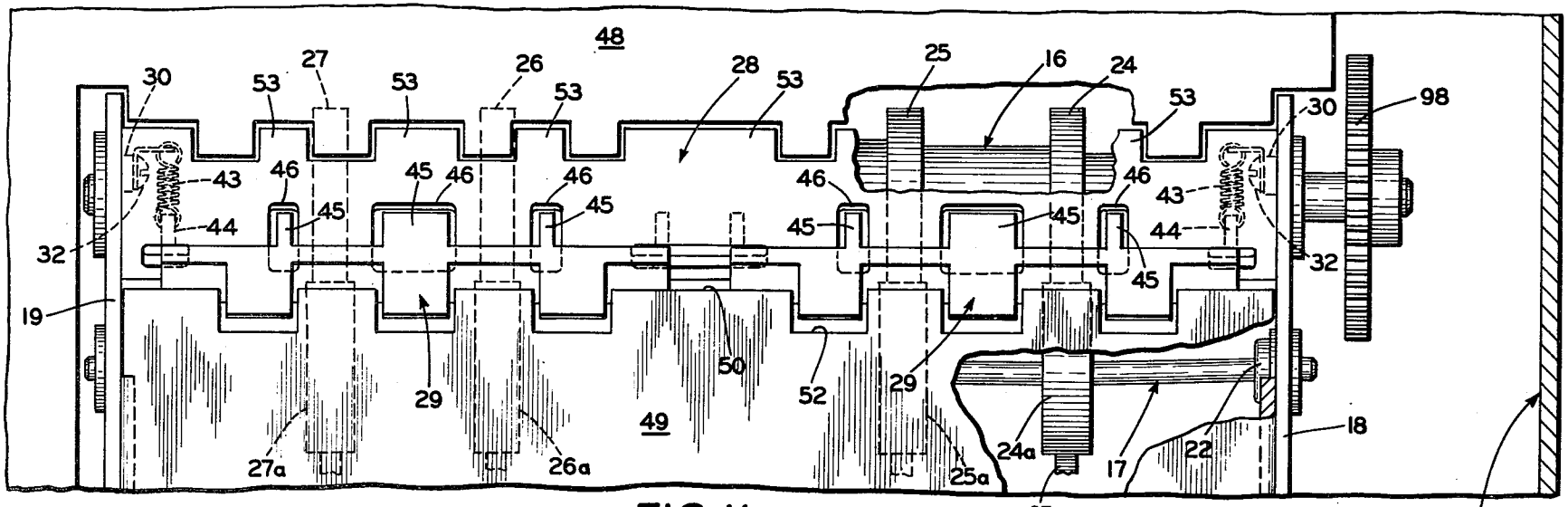
FIG. 11 is a plan sectional view, looking in the direction of the arrows 11—11, FIG. 4, of the conveyor platen with the conveyor belt removed and showing the guide members in closed position in the platen entry slot.
Figure 12:
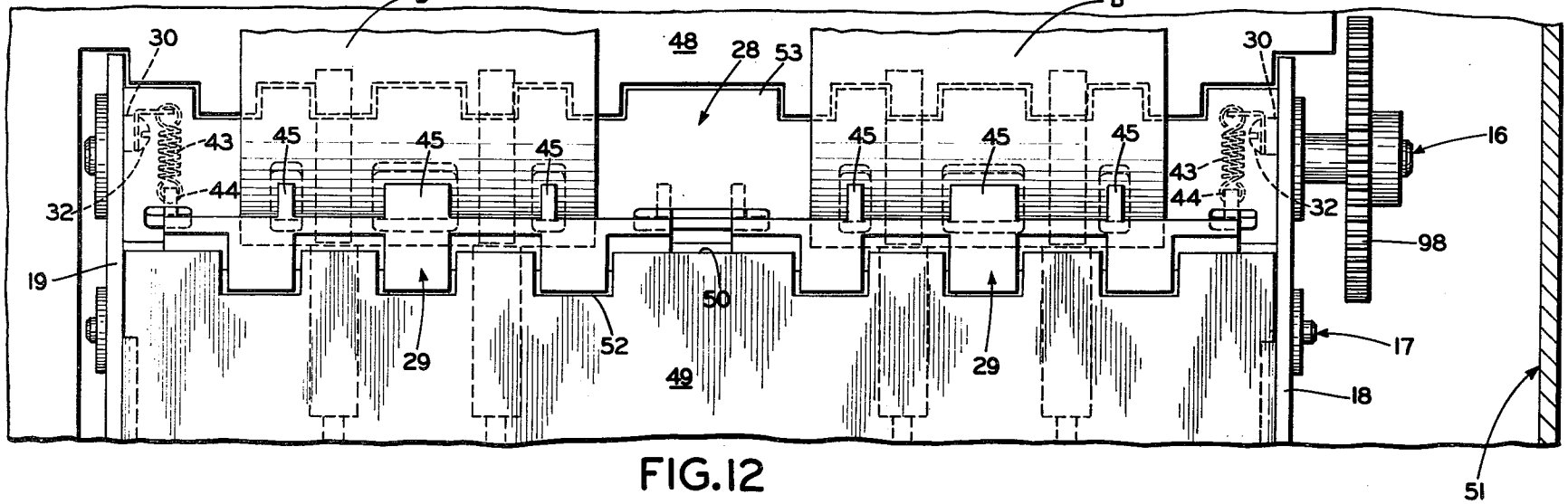
FIG. 12 is a view similar to FIG. 11 but showing the guide members in open position with a bill passing therebetween.
Figure 13:
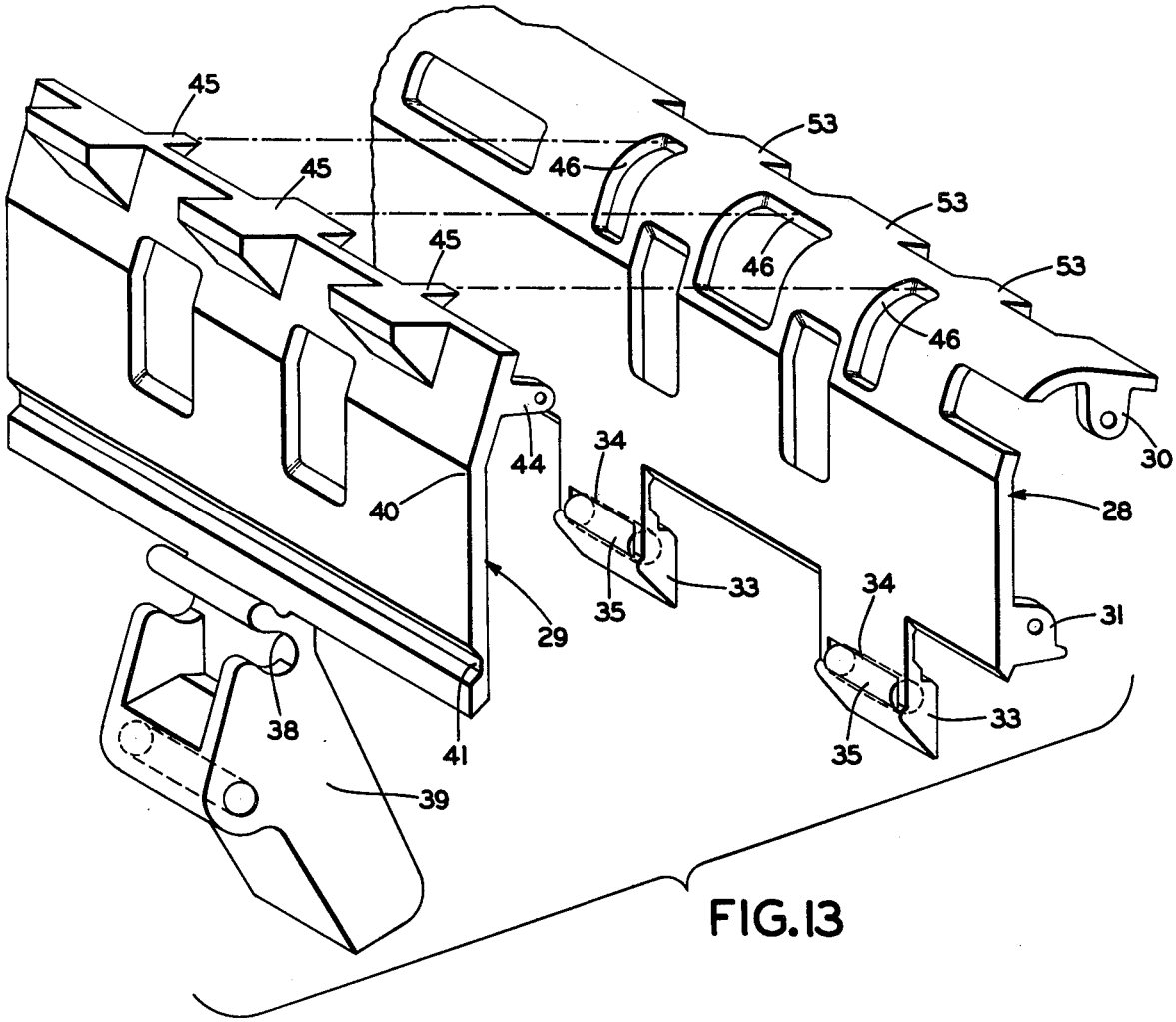
FIG. 13 is a exploded perspective view of the two guide members shown in FIGS. 11 and 12.

The description of the equipment illustrated in FIGS. 1 through 15 applies to the modified form of construction illustrated in FIG. 16 except that the gauging means 13 provided by the rolls 24, 25, etc. and switch means 64 are omitted, the guide members 28 and 29 are shortened and the Bills B are fed from rolls 35 and 36 directly between the guide members 28 and 29 to enter the belt conveyor means 14.

A photosensor is provided between the gate entry slot 52 and the rolls 36 and 37, comprising a light source 104 and an electric eye 105. The sensor 104–105 acts as a thickness gauging means which operates continuously to provide signals of thickness and thickness changes at the output of the photosystem detector 105. These signals essentially are the same as the signals produced by the switch means 64 in the first embodiment.

In other words, the signals produced mechanically by deflection or the light beam signals produced by attenuation of the light beams act as bill thickness measurement signals and are processed through the electronic systems described below in the same manner to produce time averaging of the bill thickness and to generate decision signals indicating the presence or absence of doubles.

Referring now to FIGS. 17–25, several control circuits for detecting doubles in accordance with the invention are described below.

FIG. 17 shows a simplified block diagram of the basic doubles detector circuit. The signal $V_s$ may be generated by a mechanical gauge or detector, such as gauging means 13 (FIGS. 1-15) or by an optical system, such as 104–105 (FIG. 16), and is supplied to an averaging or integrator circuit 106. Integrator 106 is any of several circuits as described in detail below, which time averages or integrates the thickness measurements made by gauging means 13 or photosystem 104–105. The terms "time average" or "integrate" are interpreted herein to mean averaged or integrated with respect to time over substantially the entire length of the gauged portion of a bill B. The terms "time averaged" or "integrated" also comprehend variations of the invention wherein averaging or integrating is made as a function of another independent variable, such as length or position.

The output of $V_{int}$ of integrator 106 represents the average measured thickness of the bill B over substantially the entire length of the gauged portion of the bill and is supplied to a comparator 107 which compares the signal $V_{int}$ (which is a function of $V_R$ and bill thickness) with a reference signal $V_R$ generated by a reference circuit 108. The output signal $V_o$ of comparator 107 is responsive to the result of the comparison and indicates whether or not the bill B can be classified as a doubles.

Referring to FIG. 18, integrator 106 comprises a resistor 109a in series with diode 109 connected to one input of comparator 107, a predetermined reference signal being supplied to the remaining input by potentiometer 110. Resistor 110*a* and capacitor 110*b* are connected between the cathode of diode 109 and ground. The anode of diode 109 in turn is connected to the output of the thickness detector, preferably the thickness gauging means 13. It is to be understood, however, that the circuits shown in FIG. 18 may be used in combination with any suitable thickness sensor that generates a digital signal in response to bill thickness, for example, a logic 1 signal in response to a doubles and a logic 0 signal in response to no doubles.

The detector or sensor signal $V_s$ is supplied to capacitor 110*b* through the diode 109, the exponential value of the signal being stored on the capacitor. Discharge of capacitor 110*b* is blocked by diode 109 and by the high input impedance of comparator 107, discharge of the capacitor being provided only through the resistor 110*a* at a controlled rate. The output $V_o$ of comparator 107 is responsive to the magnitude of voltage stored on capacitor 110*b* compared to the magnitude of voltage provided by reference potentio-meter 110. The magnitude of voltage stored on capacitor 110*b* is a function of the average measured thickness along the gauged portion of the bill, that is, when there is a doubles, a logic 1 signal is generated by gauging means 13, causing capacitor 110*b* to charge up toward the logic 1 voltage level, e.g. five volts. When no doubles is detected by the gauging means 13, the gauging means generates a logic 0 signal, e.g. 0 volts, permitting capacitor 110*b* to discharge at a controlled rate through resistor 110*a*. Thus, the voltage stored on capacitor 110*b* at any time is dependent upon the duration of time that a doubles is detected by gauging means 13 compared to a total detecting time, which is defined in this embodiment as "average."

The operation of the FIG. 18 circuit shown is described in more detail with respect to FIGS. 19*a*–19*c*. FIG. 19*a* shows typical detector signals $V_s$, generated by gauging means 13, as a function of time for two successive bills being moved through the gauging means. As shown, the output of gauging means 13 is at logic 0 when no doubles is detected and is at logic 1 when a doubles is detected. The output of gauging means 13 for the first bill shows that the thickness of only two relatively short portions of the bill is large enough to cause gauging means 13 to indicate a doubles. These relatively short thick portions of a bill are characteristic of transient thicknesses that might be caused by dirt or creases associated with a single bill. The first pulse charges capacitor 110*b* to a relatively low voltage because the width of the first pulse A is small. The second, wider pulse B charges capacitor 110*b* by an incremental voltage, but the total voltage stored on capacitor 110*b* is less than a threshold voltage generated by potentiometer 110, FIG. 17.

Thus, the first bill is recognized as being a single bill despite the existence of the transient regions defined by pulses A and B. This in contrast with prior art systems with which we are aware, wherein the occurrence of transient regions having magnitudes greater than a predetermined magnitude would tend to incorrectly identify the bill as a doubles. FIG. 19*c* shows that the output signal $V_o$ is at logic 0, indicating that no doubles has been detected.

On the other hand, assuming that gauging means 13 now generates pulses C, D and E having the relative widths shown in FIG. 19*a*, capacitor 110*b* successively charges up to the voltage level shown, which is greater than the magnitude of the threshold voltage shown in dotted lines. This indicates that the average thickness of the second bill is large enough to be classified as a doubles, a logic 1 signal thereby being generated by comparator 107, as shown in FIG. 19*c*.

It is apparent that successive incremental voltages generated by gauging means 13 during gauging of each bill accumulate toward a maximum magnitude to be examined by comparator 107. The time constant of resistor 110*a* is made large enough to prevent discharge of the capacitor 110*b* between logic 1 signals of pulses within a bill, but small enough to permit the capacitor 110*b* to substantially fully discharge between bills, as shown in FIG. 19*b*.

Referring now to FIG. 20, another embodiment of the doubles detector circuit is shown, wherein the output of a thickness detector, such as the mechanical gauging means 13 or photosystem 104–105 is sampled at predetermined, short time intervals. The output of the detector at the sampled intervals is classified as a logic 1 or logic 0, depending upon whether or not a doubles is detected at each sample time; and the total number of logic 1 signals (doubles) compared to the total number of samples of counted to determine whether the bill is to be classified as a doubles.

The output $V_s$ of the detector is supplied to a conventional signal sampling circuit 111, which samples the detector output at predetermined, equal, short time durations, as shown in FIG. 21*b*, corresponding to points distributed along the gauged portion of the bill. Assuming that the output of the thickness detector, as shown in FIG. 21*a*, is identical to the output as shown in FIG. 19*a*, pulses are generated by the signal sampler 111 coinciding with the detector signal $V_s$ (FIG. 21*a*) at the sample times (21*b*).

The pulses generated by signal sampler 111, as shown in FIG. 21*c*, are supplied to a pulse counter 112 which counts the number of pulses generated by the sampler over the gauged portion of each bill. The output of pulse counter 112 is monitored by a digital threshold circuit 113 that generates a signal $V_o$ indicative of a doubles only if the number of pulses counted by pulse counter 112 for each bill meets or exceeds a predetermined amount, the counter being reset after each bill. For example, assuming that the threshold count of digital threshold circuit 113 is 7, no signal is generated by the threshold circuit during gauging of the first bill since only five pulses are counted, whereas a signal is generated during the second bill coinciding with the seven pulses generated by sampler 111 (see FIG. 21*d*).

It is apparent that the number of pulses that are counted by pulse counter 112 during gauging of each bill is proportional to the average thickness of the bill throughout the gauged portion thereof. Thus, the circuit shown in FIG. 20 is responsive to average thickness of the bill.

In practice, a bill remains in contact with gauging means 13 for approximately 180 milliseconds along its path of travel, and is sampled 40 times. The number of samples indicating a double may be 20, for example, before the bill being gauged is classified as a doubles.

Figure 22:
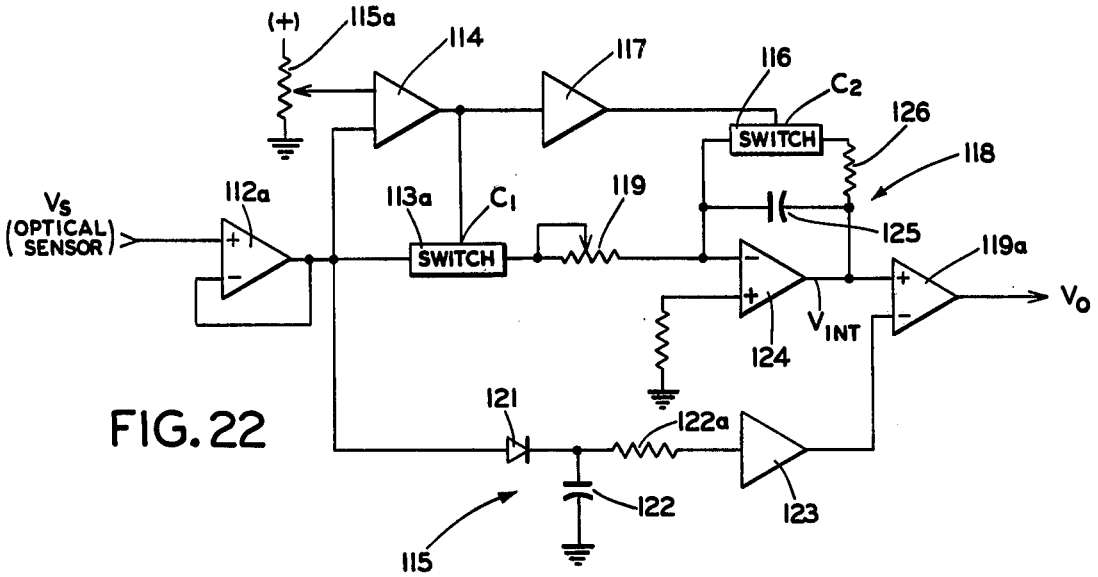
Figure 23A:
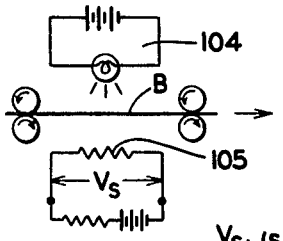

Referring to FIG. 22, another embodiment of a doubles detector circuit, in accordance with the invention is shown. The circuit of FIG. 22 is especially adapted for, but not limited to, use with an optical thickness detector of the type referred to hereinabove, as shown in FIG. 23*a*, having an output characteristic of the type shown in FIG. 23*b*. A bill B being gauged is moved along its path of travel between light source 104, which may be an incandescent lamp or LED, for example, and an electric eye or photocell 105. Exposure of bill B to detector 105 during movement of the bill is herein referred to as "scanning" of the bill.

Output voltage $V_s$ of detector 105 is maximum when there is no bill B between lamp 104 and detector 105. It is to be understood, however, that the operation of detector 105 could be reversed.

Figure 23B:
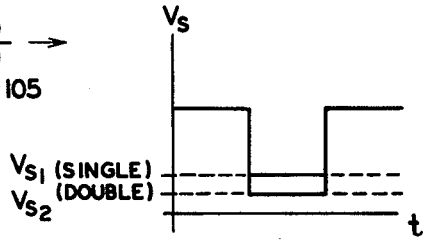

In the present case, as shown in FIG. 23*b*, the detector voltage $V_s$ drops to a first level $V_{s1}$ in response to the transmiscivity of a single bill, and to a second, lower level $V_{s2}$ in response to the smaller transmiscivity of a doubles. Due to the gain characteristic of a photodetector circuit, however, there is a relatively small difference in voltage between blockage of light by a single bill and blockage of light by a doubles. Furthermore, the wave forms shown in FIG. 23*b* represent the ideal case, wherein the bills have constant transmiscivity along the entire gauged portion thereof. In practice, transient transitions are made between the single bill, blocked detector voltage $V_{s1}$, and doubles bill, blocked detector voltage $V_{s2}$.

In accordance with the circuit shown in FIG. 22, as with the circuits shown in FIGS. 18 and 20, a single bill or a doubles is classified in accordance with the averaged thickness, or light transmiscivity or opacity, of the bill along the gauged portion thereof. In principle, the circuit of FIG. 22, monitors the amount of light received by photodetector 105 in order to determine whether no bill is located or is passing between lamp 104 and the detector or at least one bill is passing therebetween. When at least one bill is passing between lamp 104 and photodetector 105, the output of detector 105 is supplied to an integrator circuit. Since detector 105 generates a higher magnitude of voltage in response to a single bill than it generates in response to a doubles bill, and since the output of an integrator in response to a constant or DC voltage is a ramp having a slope proportional to voltage magnitude, it is apparent that the slope of the ramp voltage, as generated by the integrator, is greater for a single bill.

Furthermore, it is apparent that the minor transients or perturbations would tend to be smoothed or averaged by the integrator with only a small change in slope being effected. That is, the slope of the ramp generated by the integrator is substantially unaffected by transient changes in opaqueness or transmiscivity of the bill, since such transient characteristics are "integrated out."

The presence of a single bill or a doubles can thus be accurately determined by monitoring the output of the integrator at a predetermined period of time to determine whether the output voltage is above or below a predetermined magnitude. For example, if the integrator output voltage is above a predetermined magnitude at a predetermined time, the bill being gauged is classified as a single bill. Alternatively, the output of the integrator may be continuously monitored, and the time measured at which the output reaches a predetermined magnitude. If the predetermined magnitude is reached prior to a predetermined time, for example, the bill would be classified as a single bill.

Referring now to FIG. 22 in more detail, the output of detector 105 is supplied to a buffer circuit 112*a* to prevent loading of the detector. The output of buffer 112*a* in turn is connected to the input of a first analog switch 113*a*. Also connected to the output of buffer 112*a* are a comparator 114 and a peak detector identified generally by the numeral 115. The output voltage of buffer 12*a* is maximum when there is no bill between lamp 104 and detector 105 as aforementioned. This condition is referred to herein as quiescent. The output voltage of buffer 112*a* drops to a lower level when there is at least one bill between the lamp 104 and detector 105 causing light blockage.

Comparator 114 compares the voltage generated by buffer 112*a* with a reference voltage generated by potentiometer 115*a* in order to determine whether or not at least one bill is located between the lamp 104 and detector 105. When there is at least one bill located between the lamp 104 and detector 105, the voltage at the output of buffer 112*a* will be lower in magnitude than the reference voltage at 115*a*, whereby a control signal is generated by the comparator 114. The control signal generated by comparator 114 is supplied to control terminal $C_1$ of switch 113*a* and control terminal $C_2$ of a second analog switch 116. The control signal supplied to the switch 116 is inverted in an invertor circuit 117 so that switches 113*a* and 116 are always in opposite states, that is: the first switch is on and the second switch is off and vice versa.

The output of the first switch 113*a* is supplied to a conventional integrator circuit 118, corresponding to block 106 in FIG. 17, through a potentiometer 119. Potentiometer 119 controls the gain of integrator 118, and is provided for the purpose of accommodating bills of different denominations or types, as explained more fully below. The output of integrator 118 in turn is connected to one input terminal of comparator circuit 119*a*, corresponding to block 107 in FIG. 17. The remaining input of comparator 119*a* is connected to the output of peak detector circuit 115 which develops a reference voltage for comparator 119 that is derived from the peak, or quiescent, voltage generated by detector 105. The reference voltage for comparator 119*a* is derived from the quiescent voltage, or unblocked detector voltage, so that the reference voltage is automatically compensated for conditions unrelated to bill thickness, such as different or changing detector parameters, dirt in the optical system, etc.

Peak detector 115 which corresponds to block 108 in FIG. 17 comprises a diode 121 connected to storage capacitor 122 and to inverter 123 through resistor 122*a*. The purpose of inverter 123 is to invert the polarity of the peak or quiescent voltage stored on capacitor 122 to be supplied to comparator 119*a* for comparison with the integrator 118 voltage.

Integrator 118 comprises a conventional operational amplifier 124 having a capacitor 125 in the feedback loop thereof, in a conventional manner. Switch 116 is connected across the capacitor 125 through a small resistor 126 so as to turn the integrator on and off at predetermined times.

In operation, when a bill is located between the light source 104 and detector 105, switch 113*a* is turned on and switch 116 is turned off by the output of comparator 114. In this condition, the integrator is enabled and a signal flow path is established between buffer 112*a* and integrator 118. The output of integrator 118 is thus a ramp having a slope proportional to the magnitude of the detector signal $V_s$, which in turn is a function of instantaneous bill thickness.

Figure 24:
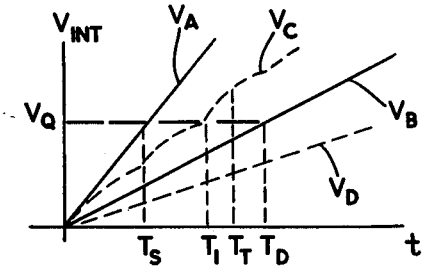

FIG. 24 illustrates the operation of integrator 118, wherein ramp $V_A$ corresponds to light transmitted through a single bill and having a relatively large slope, and $V_B$ corresponds to the response of detector 105 to light transmitted through a doubles, and has a relatively smaller slope. The time at which voltage of the ramp $V_A$ intersects the quiescent or reference voltage $V_Q$ is $T_S$, and the time at which ramp $V_B$ intersects the reference voltage $V_Q$ is $T_D$. Accordingly, a longer period of time elapses before the output of integrator 118 reaches the reference voltage $V_Q$ when there is a doubles, than when there is a single bill located between lamp 104 and detector 105.

The dotted line $V_C$ represents an actual output from integrator 118 showing non-linearities associated with transient changes in light transmiscivity or opacity along the gauged portion of a bill, and intersect reference voltage $V_Q$ at time $T_1$. This bill may be classified as a single or a doubles, depending on the definitions, which depend upon average thickness or opacity, applied. It is thus apparent that the number of bills, that is, whether there is a single bill or doubles, between lamp 104 and detector 105 can be determined by determining whether the magnitude of the ramp voltage is above or below a predetermined magnitude at a predetermined time, as described above.

For example, in FIG. 24, at time $T_T$, the magnitude of $V_C$ is larger than the magnitude of reference voltage $V_Q$, and the bill being gauged is classified as a single bill. On the other hand, at the time $T_T$, the magnitude of ramp $V_D$ is less than $V_Q$, and the bill is classified as a doubles.

The slope of the ramp generated by the integrator 118 is controlled by potentiometer 119, so that the operation of the integrator can be adjusted to be usable with bills of different denominations or types while maintaining a constant time at which the magnitude of the ramp is measured. In other words, the potentiometer 119 controls the slope of all ramps generated by integrator 118 whereby the circuit may be calibrated to be operative with any type or denomination of bill.

Figure 25:
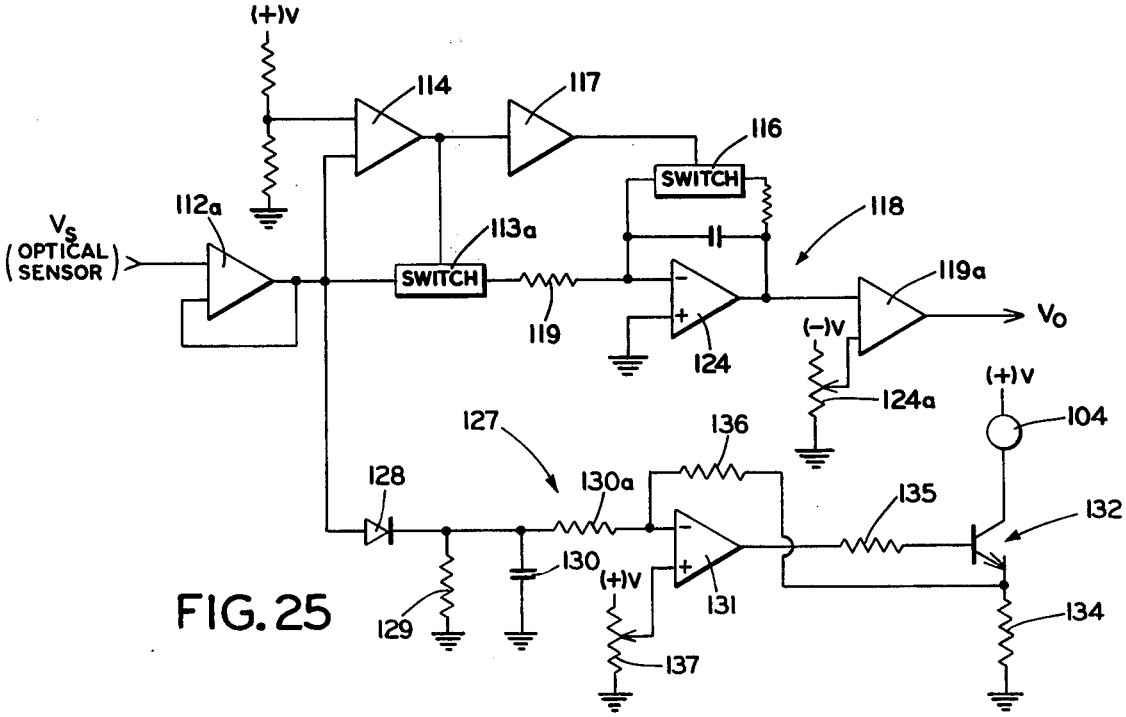

FIG. 25 shows another embodiment of the doubles detector circuit and is similar to the circuit shown in FIG. 22 except that a constant, preselected reference voltage developed by potentiometer **124*a* is supplied to one input of comparator 119*a* rather than a variable reference. Changes in ambient conditions unrelated to bill thickness are compensated by automatically adjusting the intensity of lamp 104 using a lamp driver circuit indicated generally by 127. The input of driver circuit 127 is connected to the output of buffer 112*a* so as to be responsive to the output of detector 105. Driver 127 comprises a peak detector circuit including diode 128, resistor 129 and capacitor 130, the output of which is supplied to a conventional operational amplifier 131 through resistor 130*a*. Operational amplifier 131 controls the base drive on lamp driver transistor 132 connected in series with lamp 104 and supply voltage source V. Current-limiting resistor 135 is connected between amplifier 131 and the transistor 132. Feedback is provided between emitter resistor 134 and the input of operational amplifier 131 via resistor 136**.

In operation, the voltage on capacitor 130 tracks the voltage $V_Q$, which is the quiescent or unblocked voltage generated by sensor 105. Resistor 129 is a pull down resistor to partially discharge capacitor 130 when there is a decrease in quiescent voltage $V_Q$. The voltage on capacitor 130 is used to control base drive of lamp driver transistor 132 as a function of the magnitude of quiescent voltage $V_Q$ through amplifier 131. The output of amplifier 131 is manually adjusted by potentiometer 137 to provide rated current through lamp 104. Thereafter, the current is automatically controlled to maintain a constant $V_Q$ by feedback resistor 136.

The improved doubles detector and system may be used in any of the manners described for detecting and rejecting doubles in any of the usual and known typical automatic banking units or systems.

Any such known automatic banking units which dispense paper money bills equipped with the improved doubles detector and system may have the doubles detector located in the path of travel of the bills being dispensed ahead of the location of the customer access receptacle for the bills dispensed. During operation of such a banking unit equipped with the improved doubles detector, when a signal is generated indicating the presence of doubles, the signal actuates control means for the reversing motor for the banking unit currency dispenser drive to reverse the direction of belt movement of the detector conveyor so as to convey the detected doubles contra to the normal direction of bill travel in its path of movement and to discharge the doubles into a rejected bill container.

Such doubles detecting signals under the concept described result from looking at the whole bill, averaging the bill characteristics, and making a decision as to the presence of single or multiple bills from the signals generated in respect of the average characteristics of the whole bill.

One of the advantageous features of the improved equipment disclosed and described is the cooperative arrangement between the currency dispensing and doubles detecting components, and the depository component, which are interrelated by the single reversible belt conveyor serving both dispensing and depositing functions.

A further distinctive feature of the reversible belt and flat platen means which form the bill and deposited material conveyor is the ability of the conveyor, because of its reversal characteristic, to discharge bills from the conveyor in either of two opposite directions from a conveyor entry slot located intermediate the conveyor ends, through which slot the bills are fed one by one in their path of travel to the conveyor.

Another feature is the thin shaft deflection thickness measuring concept. As described, one shaft 17 with shaft portions **17*a* and 17*b* having the midsupport 23 may be used to provide thickness measuring deflection means, one for each dispensing line. Clearly, if desired, the shaft portions 17*a* and 17*b*** may be separate shafts, each supported at its ends to provide for the deflection gauging.

Other unique features relate to the construction and operation of the various bill gauging and thickness averaging devices and procedures which accomplish doubles detection in a stream or series of bills moving one-by-one and composed of a random arrangement of old and new money.

Added to the last described features is the accuracy and reliability of the improved doubles detection operation free of inherent problems previously encountered with prior devices and systems when attempting to handle foreign currency having many and variable colors and thicknesses.

Still further advantages accrue from the thickness averaging concept which avoids difficulties encountered with prior single sampling actuation of photosensitive doubles detectors which may read the same doubles indicating parameter from two new superimposed bills as from a single much used dirty bill, thus rejecting the single used dirty bills.

Accordingly, the presence of doubles may be reliably and accurately detected in single or multiple denomination bill dispensing lines, or in such arrangements coupled with depository means by the new doubles detector mechanism and systems for currency dispensers that are incorporated in automatic banking units; and randomly arranged new and old bills may be handled in such units as well as paper money currency of various countries regardless of colors, shades of color and varying thickness of such currencies; and thus the new concepts incorporating the principles and procedures set forth, achieve the stated objectives and solve problems and satisfy needs that have existed for a considerable time in the art.

In the foregoing description, certain terms have been used for brevity, clearness and understanding; but no unnecessary limitations are to be implied beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the new doubles detector is constructed and operated, and the advantageous, new and useful results obtained; the new and useful structures, devices, components, elements, arrangements, parts, combinations, systems, steps, operations, procedures, methods and relationships are set forth in the appended claims.

We claim:

1. Doubles detector mechanism for paper money bill dispensing systems for automatic banking equipment of the type having a bill supply and a customer delivery station; including bill thickness gauging means; means for continuously moving successive bills from said bill supply past the thickness gauging means to the customer delivery station; the thickness gauging means including means for constantly sample measuring the thickness of each bill to develop thickness measurements of each bill and to generate signals related to the sample thickness measurements of each bill substantially throughout a gauged length extending in the direction of travel as such bill moves in its path of travel past the thickness gauging means, and means for averaging thickness measurements made throughout the gauged length of such bill to provide an averaged bill thickness measurement; means for comparing such averaged measurement with a reference value greater than normal bill average thickness; means for generating a doubles-detected signal when the averaged measurement exceeds said reference value; said bill supply including bills stacked in a bill container having bill access means; the means for continuously moving bills from the bill supply to the customer delivery station including picker mechanism, conveyor roll means, reversible belt conveyor means and driving means for driving said picker mechanism, conveyor roll means and reversible belt conveyor means in coordination; said picker mechanism, conveyor roll means, belt conveyor means and driving means being cooperatively constructed and arranged so that the picker mechanism removes bills one at a time from the supply stack through said access means and delivers successive removed bills to the conveyor roll means, and so that the conveyor roll means moves successive bills past the thickness gauging means and delivers such bills to the reversible belt conveyor means, and so that the reversible belt conveyor means delivers received bills to said customer delivery station.

2. The construction defined in claim 1, in which a generated doubles detected signal reverses movement of the belt conveyor means so that a doubles delivered thereto is moved away from the customer delivery station in a direction contra to normal movement in its path of travel.

3. The construction defined in claim 2, in which the mechanism includes rejected bill container means; and in which the belt conveyor means when reversed conveys doubles which have been detected to the rejected bill container means.

4. The construction defined in claim 3, in which the automatic banking equipment is provided with depository mechanism adjacent the doubles detector mechanism; and in which the reversible belt conveyor means when driven in the reverse direction conveys deposited material into the automatic banking equipment.

5. The construction defined in claim 4, in which the depository mechanism and doubles detector mechanism are housed side by side within a compartment formed in the automatic banking equipment; in which the equipment is provided with customer access facia means; in which access opening means is formed in the facia means for the customer delivery station; in which the belt conveyor means is located above both the doubles detector mechanism and the depository mechanism; in which the belt conveyor means has a delivery end and a reject end; in which a depository entry slot is formed in the facia means adjacent the belt conveyor delivery end; in which the reject bill container means is located adjacent the belt conveyor reject end; and in which the belt conveyor means when driven in reverse direction conveys deposited material entered through said deposit entry slot into said compartment.

6. The construction defined in claim 1, in which the reversible conveyor means includes a platen, belt backup means and an endless belt one flight of which passes between the platen and backup means.

7. The construction defined in claim 6, in which the belt backup means is yieldingly mounted.

8. The construction defined in claim 6, in which the platen is formed with slot means through which bills are delivered to the reversible conveyor means from the doubles detector mechanism.

9. The construction defined in claim 8, in which the slot means is provided with gate means normally closing the slot means; and in which the gate means is opened by a moving bill fed from the doubles detector mechanism to the slot means.

10. Doubles detector mechanism for paper money bill dispensing systems for automatic banking equipment of the type having a bill supply and a customer delivery station; including bill thickness gauging means; means for continuously moving successive bills from said bill supply past the thickness gauging means to the customer delivery station; the thickness gauging means including means for constantly sample measuring the thickness of each bill to develop thickness measurements of each bill and to generate signals related to the sample thickness measurements of each bill substantially throughout a gauged length extending in the direction of travel as such bill moves in its path of travel past the thickness gauging means, and means for averaging thickness measurements made throughout the gauged length of such bill to provide an averaged bill thickness measurement; means for comparing such averaged measurement with a reference value greater than normal bill average thickness; means for generating a doubles-detecting signal when the averaged measurement exceeds said reference value; said bill supply including bills stacked in a bill container having bill access means; the means for continuously moving bills from the bill supply to the customer delivery station including picker mechanism, conveyor means, reversible bill delivery and reject conveyor means and driving means for driving said picker mechanism, conveyor means, and reversible conveyor means in coordination; said picker mechanism, conveyor means and driving means being cooperatively constructed and arranged so that the picker mechanism removes bills one at a time from the supply stack through said access means and delivers successive removed bills to the conveyor means, and so that the conveyor means moves successive bills past the thickness gauging means and delivers such bills to the reversible conveyor means, and so that said reversible conveyor means delivers received bills to said customer delivery station; said reversible conveyor means having a delivery end and a reject end, the customer delivery station being located adjacent the conveyor delivery end; and the reversible conveyor means normally being driven to receive bills from the thickness gauging means and to convey such bills in the path of travel to the conveyor delivery end and to discharge such bills to the customer delivery station.

11. The construction defined in claim 10, in which a rejected bill container is mounted adjacent the conveyor reject end; in which the generation of a doubles detected signal reverses the direction of movement of the reversible conveyor means; and in which doubles delivered to the reversible conveyor means as detected are conveyed by reverse conveyor movement in a direction reverse to the normal direction of movement in a path of travel and are discharged by the reversible conveyor means to the rejected bill container.

12. The construction defined in claim 11, wherein the rejected bill container is removable; wherein the rejected bill container has lock means for closing and locking the container closed; and wherein the lock means must be locked to remove the container from its mounting.

13. In paper money bill dispensing systems for automatic banking equipment of the type having a bill supply and a customer delivery station; the combination of doubles detector mechanism including means for generating a doubles-detected signal when a doubles has been detected by said doubles detector mechanism; means for continuously moving successive bills from said bill supply through the doubles detector mechanism to the customer delivery station; said bill supply including bills stacked in a bill container having bill access means; the means for continuously moving bills from the bill supply to the customer delivery station including picker mechanism, conveyor roll means, reversible belt conveyor means and driving means for driving said picker mechanism, conveyor roll means and reversible belt conveyor means in coordination; said picker mechanism, conveyor roll means, belt conveyor means and driving means being cooperatively constructed and arranged so that the picker mechanism removes bills one at a time from the supply stack through said access means and delivers successive removed bills to the conveyor roll means, and so that the conveyor roll means moves successive bills through the doubles detector mechanism, and delivers such bills to the reversible belt conveyor means, and so that the reversible belt conveyor means delivers received bills to said customer delivery station.

14. The construction defined in claim 13, in which a generated doubles detected signal reverses movement of the belt conveyor means so that a doubles delivered thereto is moved away from the customer delivery station in a direction contra to normal movement in its path of travel.

15. The construction defined in claim 13, in which the automatic banking equipment is provided with depository mechanism adjacent the doubles detector mechanism; and in which the reversible belt conveyor means when driven in the reverse direction conveys deposited material into the automatic banking equipment.

16. The construction defined in claim 15, in which the depository mechanism and doubles detector mechanism are housed side by side within a compartment formed in the automatic banking equipment; in which the equipment is provided with customer access facia means; in which access opening means is formed in the facia means for the customer delivery station; in which the belt conveyor means is located above both the doubles detector mechanism and the depository mechanism; in which the belt conveyor means has a delivery end and a reject end; in which a depository entry slot is formed in the facia means adjacent the belt conveyor delivery end; and in which the belt conveyor means when driven in reverse direction conveys deposited material entered through said deposit entry slot into said compartment.

17. The construction defined in claim 13, in which the belt conveyor means includes a platen, belt backup means and an endless belt one flight of which passes between the platen and backup means.

18. The construction defined in claim 17, in which the belt backup means is yieldingly mounted.

19. The construction defined in claim 17, in which the platen is formed with slot means through which bills are delivered to the belt conveyor means from the doubles detector mechanism.

20. The construction defined in claim 19, in which the slot means is provided with gate means normally closing the slot means; and in which the gate means is opened by a moving bill fed from the doubles detector mechanism to the slot means.

21. The construction defined in claim 13 in which the doubles detected signal generating means is actuated by mechanically deflecting a flexible shaft on which is mounted a bill thickness gauging roll, when said gauging roll is engaged by a doubles moved past the doubles detector mechanism.

22. In paper money bill dispensing systems for automatic banking equipment of the type having a bill supply and a customer delivery station; the combination of bill thickness gauging means; means for continuously moving successive bills from said bill supply past the thickness gauging means to the customer delivery station; the thickness gauging means including a pair of first and second gauging rolls between which successive bills move, first and second shafts on which said first and second rolls respectively are mounted, the first shaft having rigidity against bowing, the second shaft being slightly bowed to maintain contact between the first and second rolls the bowing of which is increased to a degree dependent upon the thickness of bills conveyed between said rolls, and switch means engaging the second roll actuated to generate a doubles detected signal upon movement of a doubles between the rolls; said bill supply including bills stacked in a bill container having bill access means; the means for continuously moving bills from the bill supply to the customer delivery station including picker mechanism, conveyor means, reversible bill delivery and reject conveyor means and driving means for driving said picker mechanism, conveyor means, and reversible conveyor means in coordination; said picker mechanism, conveyor means and driving means being cooperatively constructed and arranged so that the picker mechanism removes bills one at a time from the supply stack through said access means and delivers successive removed bills to the conveyor means, and so that the conveyor means moves successive bills past the thickness gauging means and delivers such bills to the reversible conveyor means, and so that said reversible conveyor means delivers received bills to said customer delivery station; said reversible conveyor means having a delivery end and a reject end, the customer delivery station being located adjacent the conveyor delivery end; and the reversible conveyor means normally being driven to receive bills from the thickness gauging means and to convey such bills in the path of travel to the conveyor delivery end and to discharge such bills to the customer delivery station.

23. The construction defined in claim 22, in which a rejected bill container is mounted adjacent the conveyor reject end; in which the generation of a doubles detected signal reverses the direction of movement of the reversible conveyor means; and in which doubles delivered to the reversible conveyor means as detected are conveyed by reverse conveyor movement in a direction reverse to the normal direction of movement in a path of travel and are discharged by the reversible conveyor means to the rejected bill container.

24. Doubles detector mechanism for paper money bill dispensing systems for automatic banking equipment of the type having a bill supply and a customer delivery station; including bill thickness gauging means; means for continuously moving successive bills from said bill supply past the thickness gauging means to the customer delivery station; the thickness gauging means including a pair of first and second gauging rolls between which successive bills move, first and second shafts on which said first and second rolls respectively are mounted, the first shaft having rigidity against bowing, the second shaft being slightly bowed to maintain contact between the first and second rolls the bowing of which is increased to a degree dependent upon the thickness of bills conveyed between said rolls, and switch means engaging the second roll actuated to generate a doubles detected signal upon movement of a doubles between the rolls; said bill supply including bills stacked in a bill container having bill access means; the means for continuously moving bills from the bill supply to the customer delivery station including picker mechanism, conveyor roll means, reversible bill delivery and reject conveyor means and driving means for driving said picker mechanism, conveyor roll means, and reversible conveyor means in coordination; said pair of first and second gauging rolls comprising a portion of said conveyor roll means; the reversible conveyor means normally delivering bills to the customer delivery station; and said reversible conveyor means moving bills in a direction reverse to normal delivery movement toward a reject station in response to the generation of a doubles detected signal.

25. In paper money bill dispensing systems for automatic banking equipment of the type having a bill supply and a customer delivery station; the combination of doubles detector mechanism including means for generating a doubles-detected signal when a doubles has been detected by said doubles detector mechanism; means for continuously moving successive bills from said bill supply through the doubles detector mechanism to the customer delivery station; said bill supply including bills stacked in a bill container having bill access means; the means for continuously moving bills from the bill supply to the customer delivery station including reversible belt conveyor means and driving means for driving said doubles detector mechanism and said reversible conveyor means in coordination; the reversible conveyor means including a platen, belt backup means and an endless belt one flight of which passes between the platen and backup means; the belt backup means being yieldingly mounted, the platen being formed with slot means through which bills are delivered to the reversible conveyor means from the doubles detector mechanism; the slot means being provided with gate means normally closing the slot means, and the gate means being opened by a moving bill fed from the doubles detector mechanism to the slot means.

26. The construction defined in claim 25 in which movement of the belt conveyor is reversed in response to generation of a doubles detected signal when a doubles passes through the doubles detector mechanism and through the gate means and slot means and is delivered to the reversible conveyor means.

27. The construction defined in claim 26 in which the supply stack of bills is housed in a sealed protective container.

28. The construction defined in claim 27 in which the doubles detector mechanism includes a pair of first and second gauging rolls between which successive bills move, first and second shafts on which said first and second rolls respectively are mounted, the first shaft having rigidity against bowing, the second shaft being slightly bowed to maintain contact between the first and second rolls the bowing of which is increased to a degree dependent upon the thickness of bills conveyed between said rolls, and switch means engaging the second roll actuated to generate a doubles detected signal upon movement of a doubles between the rolls.

29. In doubles detector mechanism for paper money bill dispensing systems of automatic banking equipment of the type having a bill supply and a customer delivery station; bill thickness gauging means through which bills are moved from the bill supply to the customer delivery station; said thickness gauging means including a pair of first and second gauging rolls between which successive bills move, first and second shafts on which said first and second rolls respectively are mounted, the first shaft having rigidity against bowing, the second shaft being slightly bowed to maintain contact between the first and second rolls the bowing of which is increased to a degree dependent upon the thickness of bills conveyed between said rolls, and switch means engaging the second roll actuated to generate a doubles detected signal upon movement of a doubles between the rolls.

30. In paper money bill dispensing systems for automatic banking equipment of the type having a bill supply and a customer delivery station; the combination of doubles detector mechanism including means for generating a doubles-detected signal when a doubles has been detected by said doubles detector mechanism; depository mechanism adjacent the doubles detector mechanism; the depository mechanism and doubles detector mechanism being housed side by side within a compartment formed in the automatic banking equipment; the banking equipment being provided with customer access facia means; said facia means being formed with a depository entry slot through which deposited material is entered into the compartment and being formed with bill delivery receptacle means through which paper money bills are dispensed to a customer; belt conveyor means located above the side by side depository and doubles detector mechanism; said belt conveyor means including a platen, belt backup means and endless belt means one flight of which passes between the platen and backup means; the belt backup means being yieldingly mounted to accommodate conveyance of deposited material of varying thickness; the platen being formed with a deposit slot through which deposited material is discharged from the belt conveyor means into the depository; and drive means for the belt conveyor means to move deposited material from the depository entry slot along the platen between the endless belt means and platen to the depository slot, and to move paper money bills from the supply stock and doubles detector mechanism along the platen between the endless belt means and platen to the customer delivery station bill delivery receptacle means.

* * * * *